US007536021B2

(12) United States Patent
Dickins et al.

(10) Patent No.: US 7,536,021 B2
(45) **Date of Patent: *May 19, 2009**

(54) UTILIZATION OF FILTERING EFFECTS IN STEREO HEADPHONE DEVICES TO ENHANCE SPATIALIZATION OF SOURCE AROUND A LISTENER

(75) Inventors: Glen Norman Dickins, Braddon (AU); David Stanley McGrath, Bondi (AU); Adam Richard McKeag, Blakehurst (AU); Richard James Cartwright, Pymble (AU); Andrew Peter Reilly, Hurlstone Park (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/688,716

(22) Filed: Mar. 20, 2007

(65) Prior Publication Data

US 2007/0172086 A1 Jul. 26, 2007

Related U.S. Application Data

(63) Continuation of application No. 09/508,713, filed as application No. PCT/AU98/00769 on Sep. 16, 1998, now abandoned.

(30) Foreign Application Priority Data

| | | |
|---|---|---|
| Sep. 16, 1997 | (AU) | P09221 |
| Mar. 25, 1998 | (AU) | PP2595 |
| Mar. 31, 1998 | (AU) | PP2714 |

(51) Int. Cl.
*H04R 5/02* (2006.01)

(52) U.S. Cl. ..... 381/310

(58) Field of Classification Search ..... 381/17, 381/18, 61, 63, 309, 310, 74

See application file for complete search history.

(56) References Cited

U.S. PATENT DOCUMENTS 3,333,061 A 7/1967 Dow ..... 179/1

(Continued)

FOREIGN PATENT DOCUMENTS

DE 44 24 192 A1 1/1995

(Continued)

OTHER PUBLICATIONS

Wallach H. et al, "The Precedence Effect in Sound Localization", Journal of Psychology, American Psychological Association, Washington, US, vol. 62, No. 3, Jul. 1949, pp. 315-319, XP0007617.0 ISSN: 0022-0663.

(Continued)

*Primary Examiner*—Ping Lee
(74) *Attorney, Agent, or Firm*—Dov Rosenfeld; Inventek

(57) ABSTRACT

An apparatus for creating, utilizing a pair of oppositely opposed headphone speakers, the sensation of a sound source being spatially distant from the area between the pair of headphones, the apparatus comprising: (a) a series of audio inputs representing audio signals being projected from an idealised sound source located at a spatial location relative to the idealised listener; (b) a first mixing matrix means interconnected to the audio inputs and a series of feedback inputs for outputting a predetermined combination of the audio inputs as intermediate output signals; (c) a filter system of filtering the intermediate output signals and outputting filtered intermediate output signals and the series of feedback inputs, the filter system including separate filters for filtering the direct response and short time response and an approximation to the reverberant response, in addition to the feedback response filtering for producing the feedback inputs; and (d) a second matrix mixing means combining the filtered intermediate output signals to produce left and right channel stereo outputs.

20 Claims, 24 Drawing Sheets

U.S. PATENT DOCUMENTS

| | | | | |
|---|---|---|---|---|
| 5,371,799 | A | 12/1994 | Lowe et al. | |
| 5,432,296 | A | 7/1995 | Takeuchi et al. | 84/661 |
| 5,436,975 | A | 7/1995 | Lowe et al. | |
| 5,485,514 | A | 1/1996 | Knappe et al. | 379/372 |
| 5,491,754 | A | 2/1996 | Jot et al. | 381/63 |
| 5,590,204 | A | 12/1996 | Lee | 381/309 |
| 5,761,315 | A | 6/1998 | Iida et al. | 381/18 |
| 5,809,149 | A | 9/1998 | Cashion et al. | |
| 5,970,152 | A | 10/1999 | Klayman | 381/1 |
| 6,091,824 | A | 7/2000 | Lin et al. | 381/63 |
| 6,269,061 | B1 | 7/2001 | Shimizume et al. | 369/47.3 |
| 6,307,941 | B1 | 10/2001 | Tanner et al. | 381/309 |
| 6,449,368 | B1 | 9/2002 | Davis et al. | 381/1 |
| 6,658,117 | B2 * | 12/2003 | Hasebe | 381/18 |

FOREIGN PATENT DOCUMENTS

| | | | |
|---|---|---|---|
| DE | 43 32 504 | A1 | 3/1995 |
| DE | 195 14 105 | A1 | 10/1995 |
| JP | 55052700 | | 4/1980 |
| JP | 4200100 | | 7/1992 |
| JP | 5165485 | | 7/1993 |
| JP | 5216489 | | 8/1993 |
| JP | 6130941 | | 5/1994 |
| JP | 0637191 | | 2/1995 |
| JP | 7222297 | | 8/1995 |
| JP | 7288899 | | 10/1995 |
| JP | 9028000 | | 1/1997 |
| JP | 0762803 | A | 12/1997 |
| WO | WO 94/01933 | | 1/1994 |
| WO | WO 97/25834 | | 7/1997 |

OTHER PUBLICATIONS

Toole, Floyd E., "The future of stereo", in: *Audio,* Jun. 1997, pp. 34-39.

Flaherty, Nick, "3D audio: new directions in rendering realistic sound", in *Notebook,* Apr. 1998, pp. 49-50, 52.

* cited by examiner

UTILIZATION OF FILTERING EFFECTS IN STEREO HEADPHONE DEVICES TO ENHANCE SPATIALIZATION OF SOURCE AROUND A LISTENER

RELATED APPLICATIONS

The present invention is a continuation of U.S. patent application Ser. No. 09/508,713 filed Jul. 7, 2000 now abandoned to inventors Dickins et al. and titled "UTILISATION OF FILTERING EFFECTS IN STEREO HEADPHONE DEVICES TO ENHANCE SPECIALIZATION OF SOURCE AROUND A LISTENER."

U.S. patent application Ser. No. 09/508,713 is a national filing under 35 USC 371 of International Application No. PCT/AU98/00769 filed Sep. 16, 1998 and titled "UTILISATION OF FILTERING EFFECTS IN STEREO HEADPHONE DEVICES TO ENHANCE SPECIALIZATION OF SOURCE AROUND A LISTENER."

International Application No. PCT/AU98/00769 claims priority of Australian Patent Applications PO 9221 filed Sep. 16, 1997, PP 2595 filed Mar. 25, 1998, and PP 2714 filed Mar. 31, 1998.

The contents of all such related applications are incorporated herein by reference.

FIELD OF THE INVENTION

The present invention relates to the fields of audio signal processing and audio reproduction, particularly over headphones and further discloses sound reproduction techniques which create enhanced effects such as specialization of objects around a listener in a computationally efficient manner.

BACKGROUND OF THE INVENTION

It would be desirable to provide for a more pleasant listening experience over a pair of headphones.

Preferably, the listening experience recreating the intended atmosphere of the original recording. In particular, preferred aspects of a pleasant listening experience include a feeling on the part of the listener that the sound is originating outside their head, or more particularly, that it is not coming from the headphones themselves. This effect is hereinafter denoted out of head (OOH). Further, and somewhat related, is the issue of naturalness in that a listener should ideally be able to close their eyes and be provided with a sense of being in a room with the performers or listening to an external set of speaker placed at a distance.

It is often the case that it is desirable to create a sense of a three dimensional surround sound environment to a headphone listener in any particular environment. For example, one popular form of environment for the utilization of headphones is on long aeroplane flights where, for example, in-flight movies or videos are shown.

Other popular uses of headphones is in a crowded environment where the listener wishes to adopt a private listening of the headphone signal while not disturbing those around the listener. It would be desirable to provide in such environments a means for providing full surround sound over headphones.

Unfortunately, when standard headphones are utilised, the out-of-head perception is lost and the sound appears to be coming from somewhere inside the listeners head and is substantially centralized.

Other sound formats face similar problems when reproduced over headphones. For example, the Dolby AC-3 format, another popular format, is designed for the placement of a number of speakers around a listener so as to create a substantially richer sound environment. Again, when headphone devices are utilised in such an environment the intended spatial location of the sound is lost and again the sound appears to come from within the head of a listener.

The convolution of the audio signals with appropriate head related transfer functions (HRTFs) is known in the art. However, such full convolution techniques often require excessive computational resources and can not be readily implemented unless appropriate resources are made available.

SUMMARY OF THE INVENTION

It is an object of the present invention to provide for an efficient method and apparatus for the simulation of an acoustic space through headphones or the like.

In accordance with an aspect of the present invention, there is provided an apparatus for creating, utilizing a pair of oppositely opposed headphone speakers, the sensation of a sound source being spatially distant from the area between the pair of headphones, the apparatus comprising: (a) a series of audio inputs representing audio signals being projected from an idealized sound source located at a spatial location relative to the idealised listener; (b) a first mixing matrix means interconnected to the audio inputs and a series of feedback inputs for outputting a predetermined combination of the audio inputs as intermediate output signals; (c) a filter system of filtering the intermediate output signals and outputting filtered intermediate output signals and the series of feedback inputs, the filter system including separate filters for filtering the direct response and short time response and an approximation to the reverberant response, in addition to feedback response filtering for producing the feedback inputs; and (d) a second matrix mixing means combining the filtered intermediate output signals to produce left and right channel stereo outputs.

The system of the present invention includes improvements which relate to the reduction in computational requirements of existing systems and improving the realism of a virtual speaker systems.

Preferably, a predetermined number of the feedback inputs are also input to the second matrix mixing means. The feedback response filtering can comprise a reverberation filter. The reverberation filter can comprise one of a sparse tap FIR, a recursive algorithmic filter or a full convolution FIR filter and the audio inputs can comprise a surround sound set of signals.

Further, in one embodiment the feedback inputs are mixed with the frontal portions of the audio inputs only.

The filter system can include a front sum filter filtering a summation of the audio inputs positioned in front of the idealized listener and the front sum filter comprises substantially an approximation of the sum of a direct and shadowed head related transfer function for the front inputs. Further, the filter system can include a front difference filter filtering a difference of the audio inputs positioned in front of the idealized listener and the front difference filter comprises substantially an approximation of the difference of a direct and shadowed head related transfer function for the front inputs. Further, the filter system can include a rear sum filter filtering a summation of the audio inputs positioned in rear of the idealized listener and the rear sum filter comprises substantially an approximation of the sum of a direct and shadowed head related transfer function for the rear inputs. Further, the filter system can include a rear difference filter filtering a difference of the audio inputs positioned in rear of the idealized listener and the rear difference filter comprises substantially an approximation of the difference of a direct and shadowed head related transfer function for the rear inputs. Further, the filter system can include a reverberation filter interconnected to the sum of the audio inputs.

In accordance with a further aspect of the present invention, there is provided a binauralization unit for binauralizing at least one input signal, the binauralization unit comprising: a first series of filters for simulating the direct sound and early echoes; a binaural reverberation processor for simulating the late reflections which further comprises: at least one recursive filter structure and a series of finite impulse response filters interconnected to the at least one recursive filter structure.

The binaural reverberation processor can comprise at least two recursive filter structures each having a left and right channel finite impulse response filter interconnected to it output with a first recursive filter structure having a longer reverberation decay time then a second recursive filter structure.

The binaural reverberation processor further can comprise a series of recursive filter structures interconnected to sum and difference filters which in turn output to left and right channel outputs.

In one embodiment, a portion of the output from one of the finite impulse response filters can be fed back to the input of one of at least one of the recursive filter structures.

In accordance with a further aspect of the present invention, there is provided a method of providing for a compact form of processing of a series of sound output signals for output as stereo signals over a pair of head phones, the method comprising the steps of convolving a predetermined constructed binaural room response with the sound output signals in real time so as to produce stereo headphone output signals.

In an embodiment the convolution is performed in utilizing a skip protection processor unit located inside a CD-ROM player unit. In another embodiment, the convolution is performed utilizing a dedicated integrated circuit comprising a modified form of a digital to analog converter. In another embodiment, the convolution is performed utilizing a dedicated or programmable Digital Signal Processor. In another embodiment, the convolution is performed on analog inputs by a DSP processor interconnected between an Analog to Digital Converter and a Digital to Analog Converter. In another embodiment, the convolution is performed on stereo output signals on a separately detachable external device connected intermediate of a sound output signal generator and the headphones the sound output signals being output in a digital form for processing by the external device. In another embodiment, the convolution is performed on stereo output signals on a separately detachable external device connected intermediate of a sound output signal generator and the headphones, the sound output signals being output in an analog form.

BRIEF DESCRIPTION OF DRAWINGS

Notwithstanding any other forms which may fall within the scope of the present invention, preferred forms of the invention will now be described, by way of example only, with reference to the accompanying drawings which.

DESCRIPTION OF PREFERRED AND OTHER EMBODIMENTS

Figure 1:
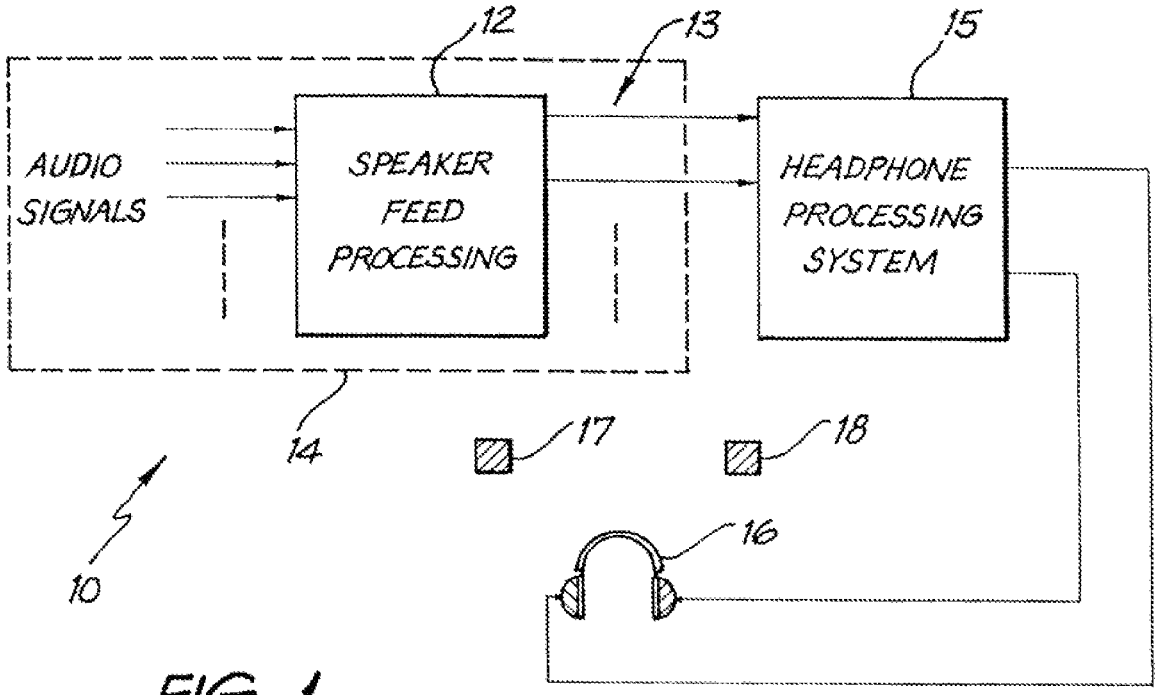
FIG. 1 illustrates the operation of a system of the present invention.

To facilitate discussion of the preferred embodiments a number of utilized terms are defined.

System:

The system for virtual rendering of sources over headphones. In abstract form it consists of a device having a number of inputs (for each speaker position) and two outputs (for left and right ear of headphones).

Transfer Function:

The signal mapping from a given input to a given output. If a system has M inputs and N outputs there are MxN possible transfer functions. If the system is linear and time invariant then these transfer functions will be static and independent. These will often be referred to individually as Input to Output transfer function (for example Left to Left, Rear Left to Right).

Filter Characteristics HRTFs:

Each transfer function has an early part of the response which represents an approximation of a particular HRTF. This part will usually be up to 100 samples in length.

HRTF Symmetry:

Where the input source virtual locations have some symmetry about the listener, the HRTFs may reflect this same symmetry. For example, where there are virtual speakers located 30 to the left and right of the listener, the HRTF or early part of the Left to Left transfer function would be identical to the early part of the Right to Right transfer function. So to the Left to Right and Right to Left would show similarity or equivalence in the early part.

Sparse Reverb

After the initial HRFTs a reverberant field approximation will be present in each transfer function. This approximation will be largely sparse. The properties of a sparse transfer function are that the filter will be in some way degenerate, having identifiable degrees of freedom covering a much smaller subset than that covered by complete freedom of the filter taps over the length of the filter.

The following are some possibilities for this sparse property:

- Actual sparse taps. The transfer function is predominantly zero with a number of non-zero taps.
- These are discrete and identical in all aspects other than amplitude and sign.
- Filtered sparse taps. The transfer function exhibits a repeated pattern at sparse positions in time.
- This is the result of passing a sparse tap type filter through a further filter to spread the taps. The sparse patterns will be identical in all aspects other than amplitude and sign. The patterns may overlap in which case it may not be so obvious to a casual observer of the presence of filtered sparse taps.
- Composite filtered sparse taps. Several unique sparse tap type sections may be created and passed through different filters. This will be identified by several different filter patterns being repeated in time identical in all aspect other than amplitude and sign. The filter patterns used by correspond to the early HRTFs of some or all of the systems transfer functions.
- Recursive sparse taps. A sparse tap with a recursive element. These sparse taps will continue indefinitely in time, decaying away as a geometric series.
- Recursive filtered sparse taps. The result of filtering a recursive sparse tap type implementation through specific filters and/or the HRTFs. This results in an algorithmic reverb with distinct filtered sparse taps initially, becoming an apparently complex response as time progresses. The filters may correspond to the early HRTFs of some or all of the systems transfer functions.

Mono Reverb

The reverberant part of the transfer functions can be derived from a mono or combined source. This is evidenced by the equivalence of transfer functions from all inputs to a particular output. For example in the stereo virtual speaker example, the Left to Left and Right to Left transfer functions would exhibit very similar characteristics in the later part of the response. Any difference in the response could be attributable to a shift in time, scaling or simple filtering operation.

Turning initially to FIG. 1, there is provided a schematic illustration of the operation of a first implementation. In this embodiment, a series of audio inputs 11 are provided to a mechanism 12 which would normally form part of the prior art taking the audio signal inputs and creating a series of speaker feeds 13. The speaker feeds 13 can be provided for the various output formats, for example stereo output formats or AC-3 output formats. The operation of the portion within dotted line 14 being entirely conventional. The speaker feeds are forwarded to the headphone processing system 15 which outputs to a set of standard headphones 16 so as to simulate the presence of a number of speakers around the listener using headphones 16.

FIG. 1 illustrates the example where headphone processing system 16 simulates the presence of two virtual speakers 17, 18 in front of the user of headphones 16 as would be the normal stereo response. The arrangement of FIG. 1 has particular advantages in that it can be incorporated in any system that is generally utilised for the playback of stereo audio. The system processes the usual signals intended for playback over speakers and is therefore compatible with and can be used in conjunction with any other system designed for enhancing the reproduction of audio over loudspeakers.

The general structure of a first example form of implementation of headphone processing system is by a filter structure where each of the intended speaker feeds is passed through two filters, one for each ear. The resultant sum of all these filters is the signal sent to the appropriate headphone channel for that ear. In alternative embodiments, the filters may or may not be updated to reflect changes in the orientation of the listener's head inside the virtual speaker array. By updating the filters based on the physical orientation of a listener's head, a more imersive head-tracked environment can be created however headtracking is also required. Various implementations can be variations on this theme so as to reduce computational requirements. Further, non-linear, active or adaptive components can be added to the structure to improve performance.

Figure 2:
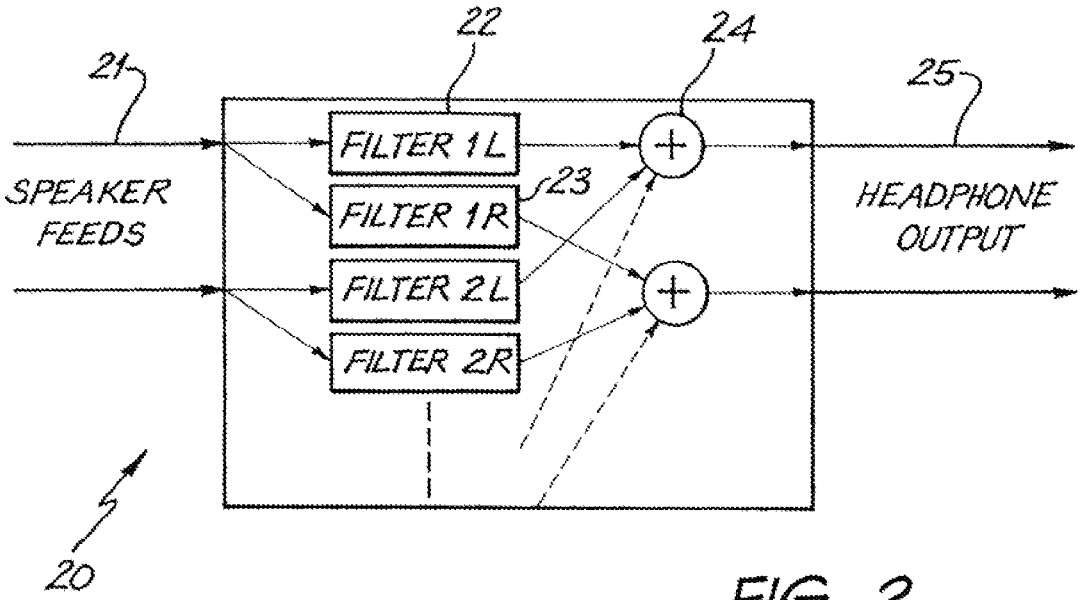
FIG. 2 illustrates a generalized form of an embodiment.

An example of the general structure a headphone processing system in a more complex form is illustrated in FIG. 2. The implementation 20 includes a series of speaker feeds e.g. 21 each of which has a separate desired impulse response filter e.g. 22, 23 applied with one filter e.g., 22 being applied for a left hand channel and one filter e.g., 23 being applied for a right hand channel. The filters represent the HRTF from the source to the corresponding ear respectively. The filter outputs are summed e.g. 24 together to form a final output 25.

The arrangement of FIG. 2 can lead to overburdening complexity in that a large number of filters e.g. 22 must be provided which is likely to substantially increase computational cost. A first technique for significantly reducing the computational requirements by taking advantage of symmetry is to utilize "shuffling" techniques. For a pair of channels, this represents applying filters to the sum and difference of the channels before recombination.

For the stereo case where the filters are symmetrically placed (i.e. FilterLL=FilterRR, FilterLR=FilterRL) this can reduce the computational requirements by 50%. This technique can be represented by inserting a linear matrix mix before and after the filter banks.

Figure 3:
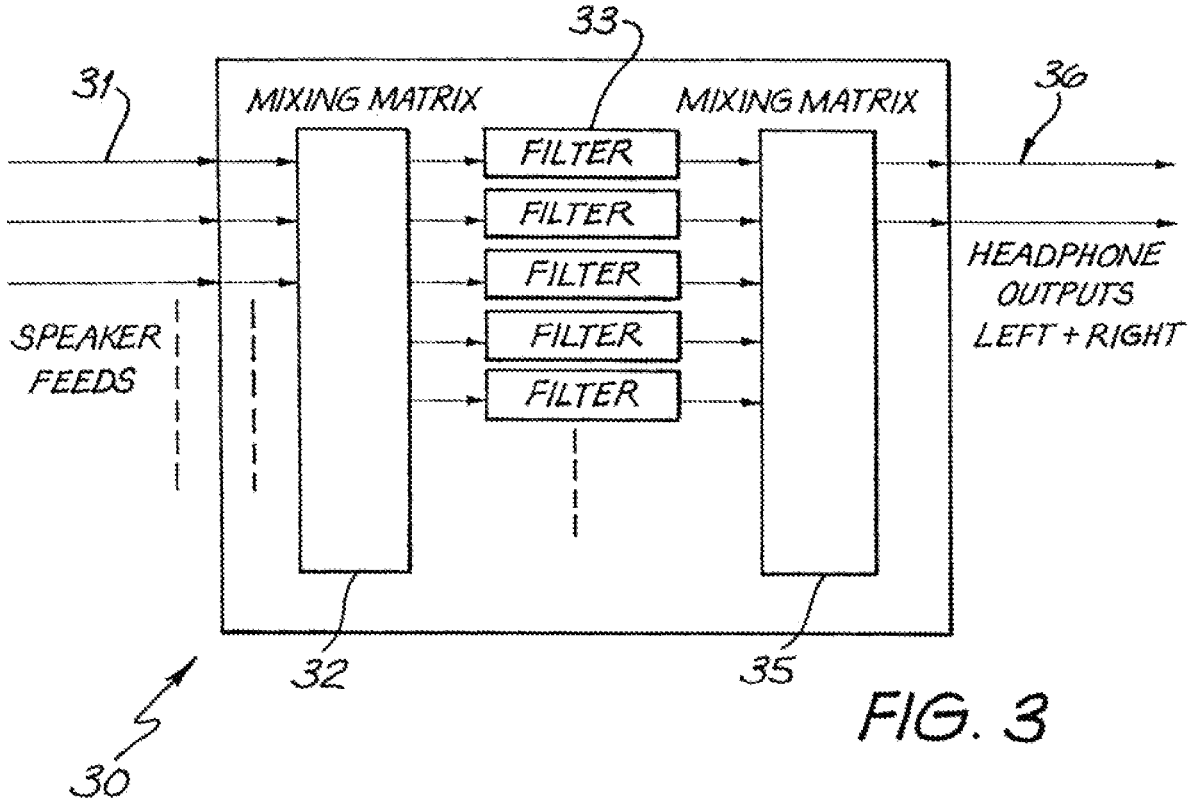
FIG. 3 illustrates a more detailed schematic form of an embodiment.

More generally, as indicated in FIG. 3, the implementation structure 30 can consists of:

- A number of inputs 31
- A mixing matrix 32 to produce a set of signals each of which is a linear combination of the input signals (note the intermediate set of signals may include the input signals themselves and may include duplicate signals>. In alternative embodiments, the matrix gains may be time varying.

A series of filters e.g. 33 on each of the intermediate signals. The filters can be independent and thus can have different structures, lengths and delays (for example IIR, FIR, sparse tap IR, and low latency convolution).

A mixing matrix 35 to combine the filtered intermediate signals appropriately to create the two headphone output signals 36.

A number of specific implementations of the general system of FIG. 3 are as follows:

High End AC-3 Decoder

Figure 4:
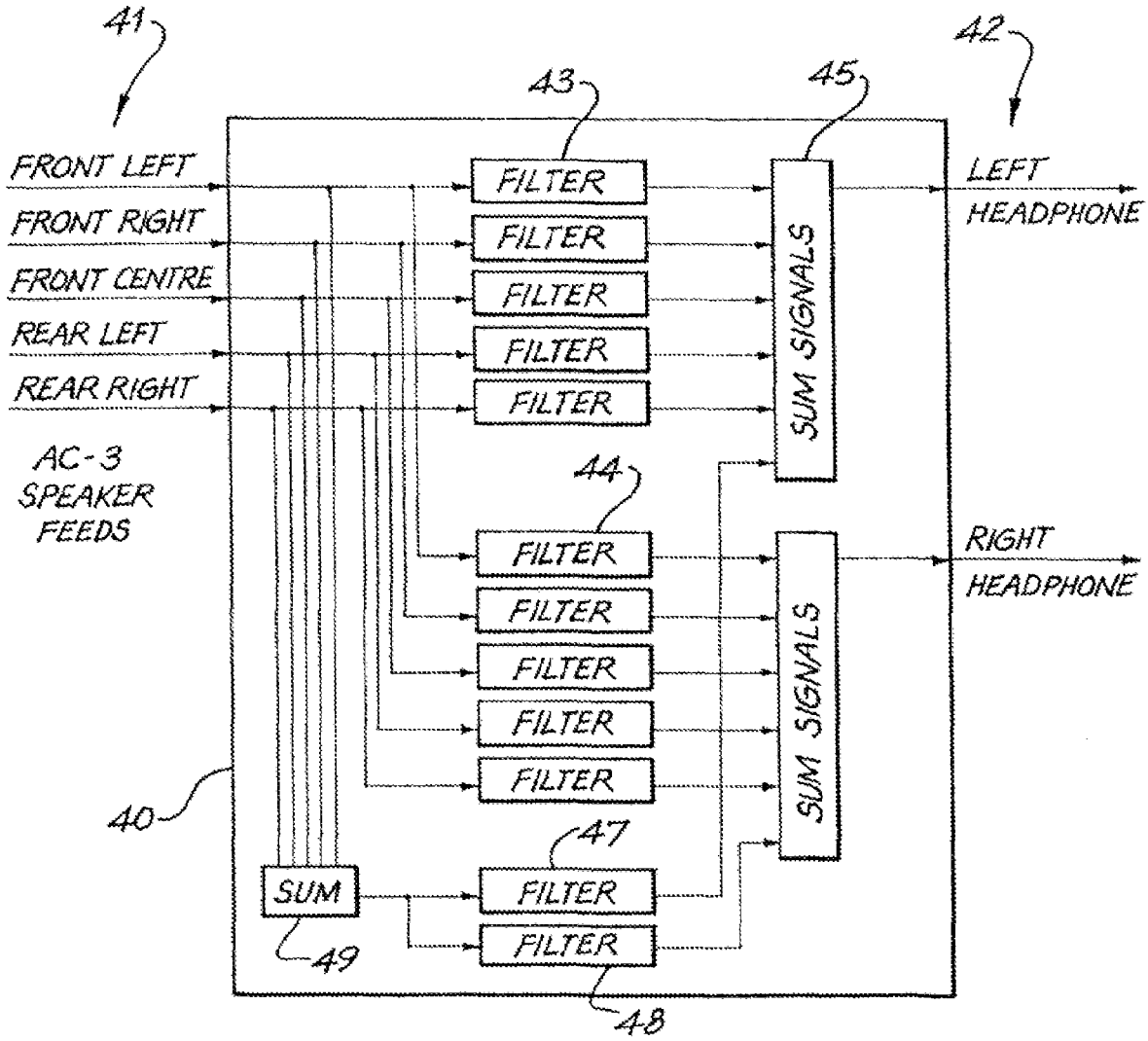
FIG. 4 illustrates a schematic diagram of a Dolby AC-3 to stereo headphone converter.

As illustrated in FIG. 4, the Dolby (Trade Mark) AC-3 (Trade Mark) standard defines a set of 5 (0.1) channels to be used as speaker feeds 41. These channels can derived from an AC-3 bit stream data source using an AC-3 decoder. Once decoded, the speaker feeds are suitable for utilization as inputs 41 to the arrangement 40 of FIG. 4 which produces headphone outputs 42. Each of the five speaker feeds is passed through a filter e.g. 43, 44 for each ear and summed e.g. 45 to produce the headphone signal—making a total of 10 filters.

The filters are provided to simulate a corresponding virtual speaker array within a room utilizing the techniques aforementioned.

To achieve a high level of quality in the simulation of a virtual speaker array, fairly long filters are required to take into account the spatial geometry of the listening environment. With proper filter sets (incorporating equalisation for the headphones and proper head related transfer functions) the results provide close to a perfect illusion of a set of external speakers being used. However, depending upon the application environment, the processing requirements may be excessive.

The 10-filter design can be refined to reduce computational power without too much quality degradation by using 10 shorter filters and only two full-length filters. The two longer filters 47, 48 can be a binaural simulation of the tail of an average room response. A combination of all 5 speaker feeds is fed via summer 49 into the binaural tail filters 47, 48 to give an approximation of the real room response. Each of the short filters e.g. 43, 44 can be the early part of the response for that particular speaker to the listener's ear.

The filter length used in prototype implementations has been typically 2000 taps at 48 kHz sampling rate for the short filters e.g. 43, 44 and 32000 taps for the longer filters 47, 48. The long filters usually have a lower bandwidth and can be implemented with latency—this can be taken advantage of using a reduced sample rate processing to lower the computational requirements. The filters can be implemented using low latency convolution algorithms, such as those disclosed in U.S. Pat. No. 5,502,747 assigned to the present applicant, to lower the system latency and computational requirements.

In the simplest case, no filter processing is utilized and the filter sets can be obtained by simulating a virtual speaker set-up using acoustic modelling packages such as CATT acoustics or by using a real or synthetic head placed inside a real speaker array.

The High End AC-3 decoder 40 provides a fairly accurate simulation through headphones of a virtual speaker array, however, it also requires a large amount of computational resource.

Low End Stereo Decoder

Figure 5:
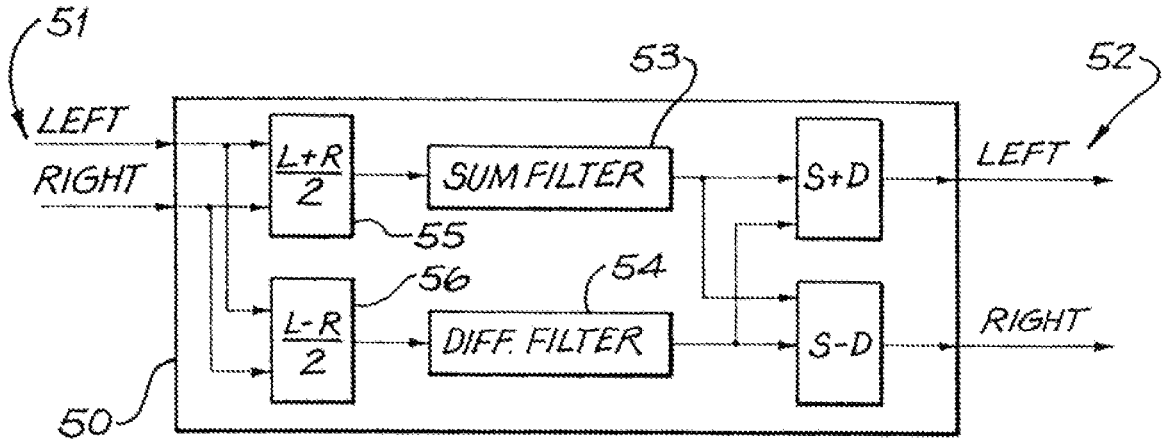
FIG. 5 illustrates a stereo input to stereo output embodiment in schematic form.

A Low-End Stereo Decoder as illustrated 50 in FIG. 5, and is a device utilizing only some of the features of the high-end computationally resourced system. The main aim is to manipulate stereo input sources for playback over headphones 52 to give the impression of the sound originating from around the listener, simulating the experience of listening to a well configured stereo. The system of FIG. 5 is designed to be suitable for mass production at a low cost; thus the more important issues of the design are in reducing the computational complexity.

As noted previously, the general structure of the low-end stereo decoder 50 has two inputs 51 for conventional stereo and two outputs 52 for the headphone signals. A bank of two filters is used with a first filter 53 operating on the sum of the left and right signals output from summer 55 and the second filter 54 operating on the difference signals output from difference unit 56.

The low end stereo decoder 50 is another example, consistent with the general implementation outlined previously. In this case the matrix operations are a two channel sum 55 and difference 56 shuffle. The filters are applied to the sum and difference signals to half the computational requirements where the desired result is speaker symmetric (i.e. L->L=R->R and L->R=R->L).

The performance of this system is dependent on the choice of filter coefficients. To reduce the computational requirements, short filters are ideally used. It has been found that the difference filter can be made somewhat shorter than the sum filter and still produce a reasonable result.

The preferred form is to use a set of filters that is a combination of the head related transfer functions for 30 speaker placement in the horizontal plane, and a semi-reverberant tail but fairly sparse filter. The filter construction can be as follows:

Given the following constructed impulse responses:

D Direct ear response—normalised to unity energy

S Shadowed ear response—scaled in proportion to D

R Reverberant response—normalised to unity energy and the following parameter

α Presence—the amount of reverberant feed in the mix then the following precomputed filters can be applied to the sum and difference signals to produce new Sum' and Diff' signals $$\underline{\text{Sum'}}](\sqrt{(1-\alpha^2)}(D+S)+\alpha R)\hat{x}\underline{\text{Sum}}$$

$$\underline{\text{Diff'}}](\sqrt{(1-\alpha^2)}(D-S))\hat{x}\underline{\text{Diff}}$$

To further reduce the amount of processing required, a number of approximations can be made to the filter set. The direct ear response is assumed to be unity. The shadowed ear response can be approximated by a 5 tap FIR matching the frequency response and group delay of the exact signal derived from deconvolving a direct ear response from the appropriate shadowed response. Around 20 sparse taps can approximate the reverberant response from a 5-10 ms delay line.

With this approach it has been found that the coefficients can be heavily quantised and reasonable performance maintained. The sum filter can be implemented as a set of 25 taps from a 256 tap delay line (at 48 kHz) while the difference filter can be mere 6 taps from a 30 tap delay line with adequate results. This allows the system to be implemented using around 3 million instructions per second (MIPS) thus making it suitable for low cost, mass production and incorporation into other audio products using headphones.

Further extensions to the implementation 50 can include:

The use of low-latency convolution to allow the possibility of longer filters.

The addition of further inputs and similar budget processing to allow for the simulation of "surround sound" formats. For example, a surround channel could be added that simulates the presence of sounds behind or around the rear of the listener.

Addition of non-symmetric components to provide better performance when the stereo signal has significant mono components in the mix.

Addition of non-linear components to enhance the performance (for example a dynamic range compressor to improve the quality of listening in a noisy environment).

It can therefore be seen that the first series of embodiments utilize a unique combination of input mixprocessing, filters and output mix-processing to create the appearance of 3-dimensional sound over headphones. The arrangements disclosed include modifications for reduced computational complexity and memory requirements resulting in a significant reduction in implementation costs. The filter structures and coefficients improve the directionality and depth of the sound with minimal increase in computational complexity. The simple HRTF approximations require little processing power having been significantly reduced from the normal 50-60 filter taps.

The significant HRTF features include:

(a) The significant main energy component of the direct response (short time approximation) and the approximation of the convolution mapping of the direct response to the shadow or reflected response.

(b) The use of filter coefficients comprising a 5-10 ms sparse tap filter after about 50-100 taps. The use of the reverberant filter enhances the performance of the HRTF approximations, normal HRTF's and room impulse responses by increasing the localisation and depth of sound.

(c) In a modification, the HRTF approximations can include coefficients for containing anti-phase component in the shadow response so as to improve rear localisation.

(d) The filters of various embodiments can include a first part which provides directionality and localisation and a second part which provides ambience and room acoustics but minimal directionality.

The utilization of the delivery format of these embodiments provides considerable flexibility in the trade off of optimal computation and memory usage versus performance.

Figure 6:
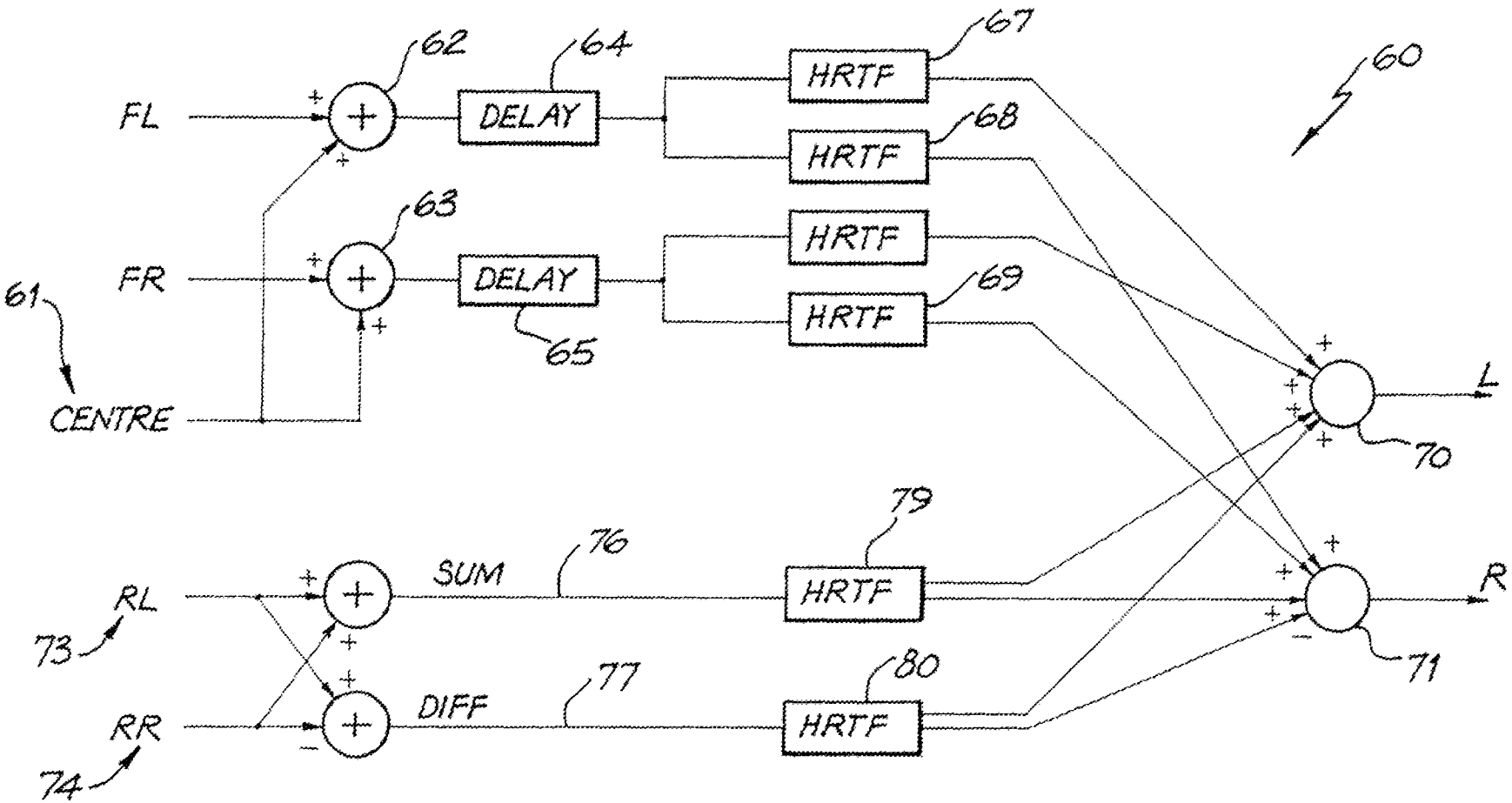
FIG. 6 illustrates in schematic form, one form of conversion from Dolby AC-3 inputs to stereo outputs in accordance with the present invention.

One extension of the system 50 of FIG. 5 to Dolby AC-3 inputs can be as shown 60 in FIG. 6. The center channel 61 is added 62, 63 to the front left and rear right channels respectively. The output signals are fed to delay units 64, 65 which can be 5 to 10 msec delay lines, before being fed to HRTFs 67-69 which provide outputs for summing 70, 71 to the left and right ears. The rear signals 73, 74 are used to form sum and difference signals 76,77 which are fed to HRTFs 79, 80 with the sum HRTF 79 being provided to both the Left and Right summing units 70,71 and the difference HRTF 80 providing anti-phase to the summing units 70, 71.

Figure 7:
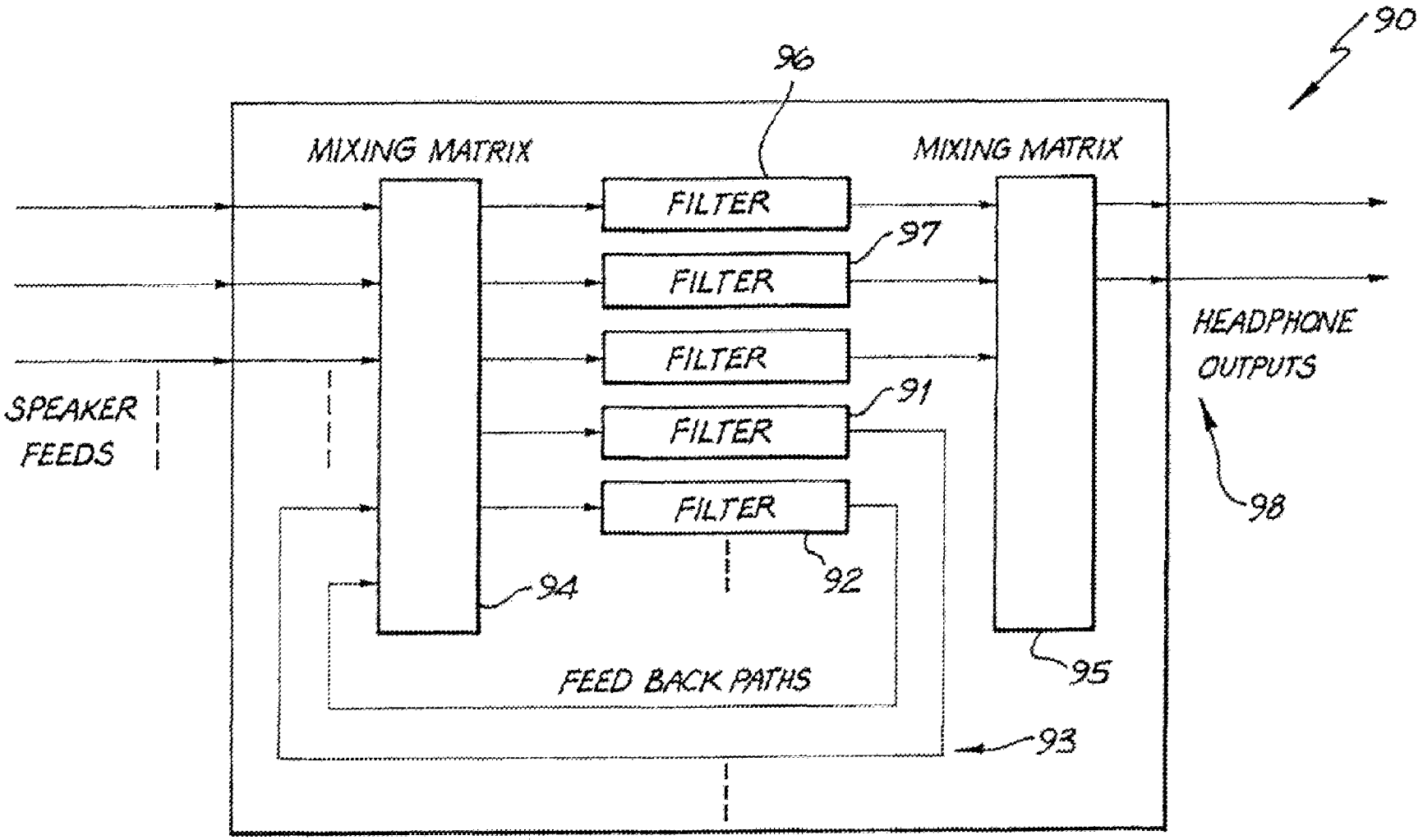
FIG. 7 illustrates a modified general embodiment.

Further modified structures are also possible. Turning now to FIG. 7 there is illustrated a first modified form 90 of the general structure previously discussed with reference to the general implementation shown in FIG. 3.

The arrangement of FIG. 7 includes filters 91, 92 and feedback path 93. The mixing matrix 94 remains a simple linear matrix with the ability to negate, scale, sum and redirect its input signals as required for a specific implementation. The outputs 93 of the feedback filters 91, 92 also go into a second mixing matrix (not shown) in a alternative embodiment, to contribute directly to the outputs 98. In an even more general arrangement, all filter outputs can be fed back to the first mixing matrix 94 at which point they may be included or excluded from the mix. However, generally it is preferably to keep the size of the mixing matrix 94 to a minimum.

The modified general structure 90 allows for a feedback path 93 having other than a recursive element within each separate filter. A more realistic reverberation can be created by feeding the outputs of a reverb filter created as part of the filter 91, 92 through the filter array e.g, 96, 97. A filtered signal can be added to the filter feed signal before HRTF filter processing. This gives the reverberation more plausible spatial components and is likely to improve the listening experience.

The reverb generating filters 91, 92 may be a sparse tap FIR, a recursive algorithmic filter or a full convolutional FIR. In all these cases it may be beneficial to feed the outputs of the reverb back into the virtual speaker feeds. The result is likely to be most significant in a low resource system where a sparse tap FIR is used to simulate the reverb. Sparse tap reflection simulations then appear to emanate from sources outside of the listener rather than from the headphones.

Figure 8:
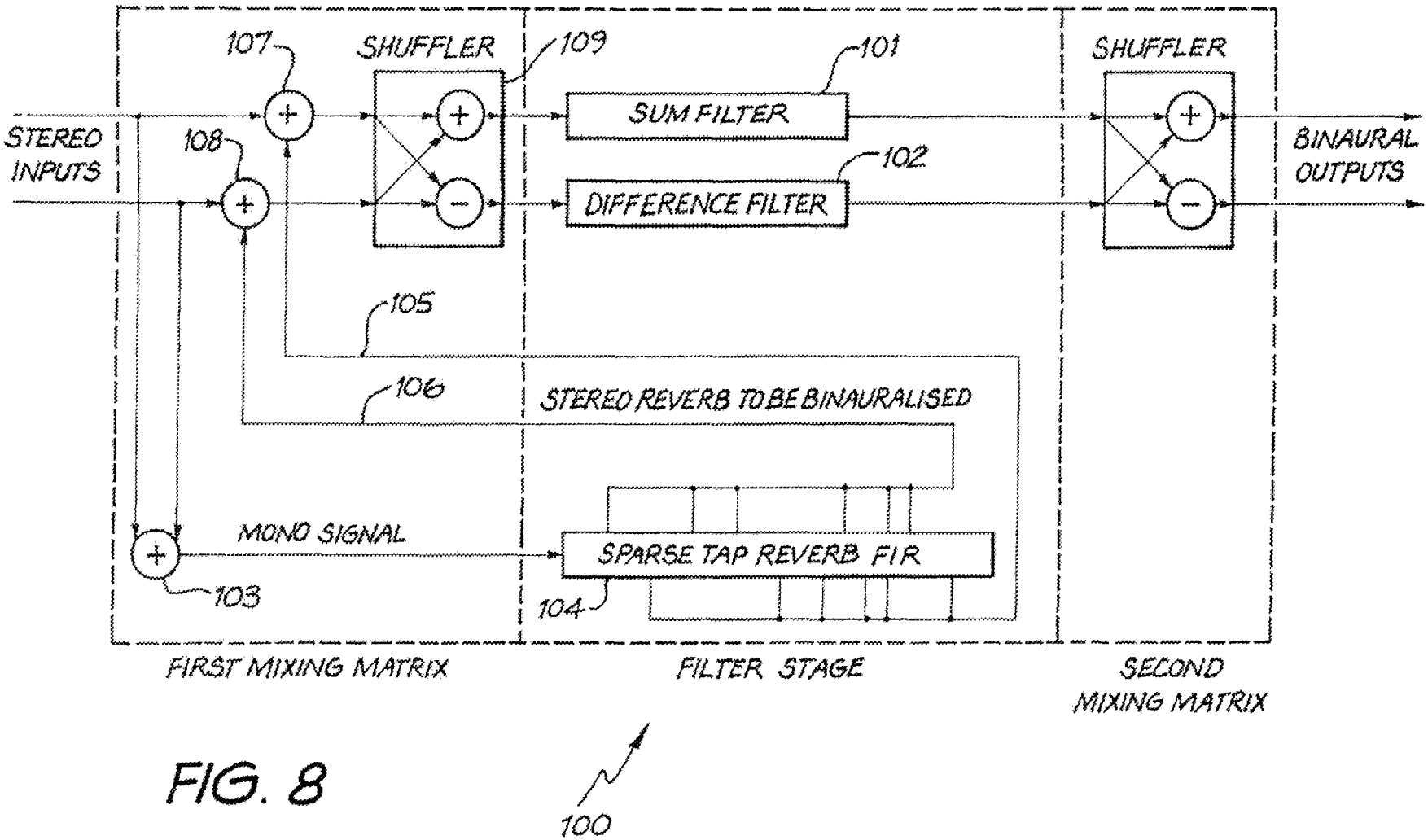
FIG. 8 illustrates a schematic diagram of a modified form of stereo mixing.

Turning now to FIG. 8, there is shown a further modified embodiment 100 similar to the embodiment 50 of FIG. 5. The arrangement includes the two sum and difference filters 101, 102 which are short time FIR approximations to the direct plus shadowed and the direct minus shadowed HRTF's of two speakers located at 30 around 30" either side of the listener. However, in the arrangement 100 of F*ig*. 8, an additional signal is derived as the sum 103 of the two inputs and fed to a single sparse tap reverberation FIR delay line 104. Two sparse tap outputs 105, 106 are derived from a set of coefficients within the FIR 104. This pair of signals 105, 106 is then added 107, 108 to the input stereo signals prior to the shuffling process 109. In this manner, the stereo sparse tap reverb is "binauralized".

Figure 9:
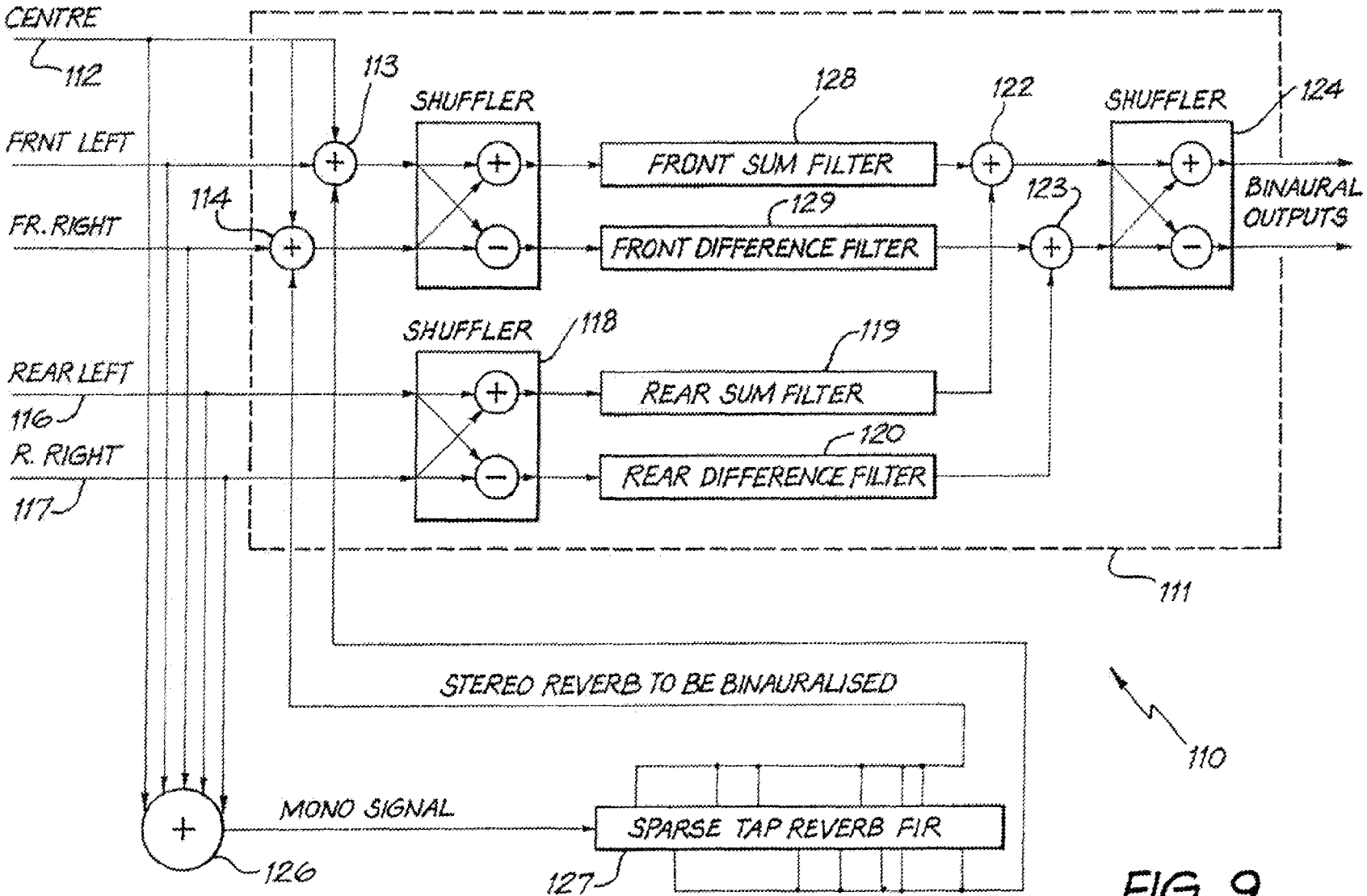
FIG. 9 illustrates a modified form of surround sound mixing.

The arrangement of FIG. 8 can be extended to a surround sound decoder similar to the arrangement of FIG. 6. Such an extension is illustrated in FIG. 9 with the portion 111 being similar to that of FIG. 6. The arrangement of FIG. 9 provides for the centre speaker feed 112 to be rendered as a virtual speaker panned midway between the front left and front right speakers. This is achieved by adding 113, 114 the centerfeed speaker 112 to the front left and front right speaker feeds. The rear speaker feeds 116, 117 have a separate shuffler 118 and sum 119 and difference filter 120 to approximate the HRTF responses for speakers located 120 either side of the front of the listener. The outputs are then mixed together 122, 123 and fed into a single shuffler 124 so as to form the binaural outputs. Each of the inputs are summed 126 to form a single mono signal for reverb processing by a sparse tap reverb FIR filter 127. The reverb filter outputs are then added to the front speaker feeds 113, 114. Whilst further reverb signals could be added to the rear speaker feeds, it is generally advantageous for the system to throw images forward to overcome psychoacoustic frontal confusion and elevation. Using only the front speaker positions for the reverb helps to throw the images forward and give a more convincing frontal sound.

Figure 10:
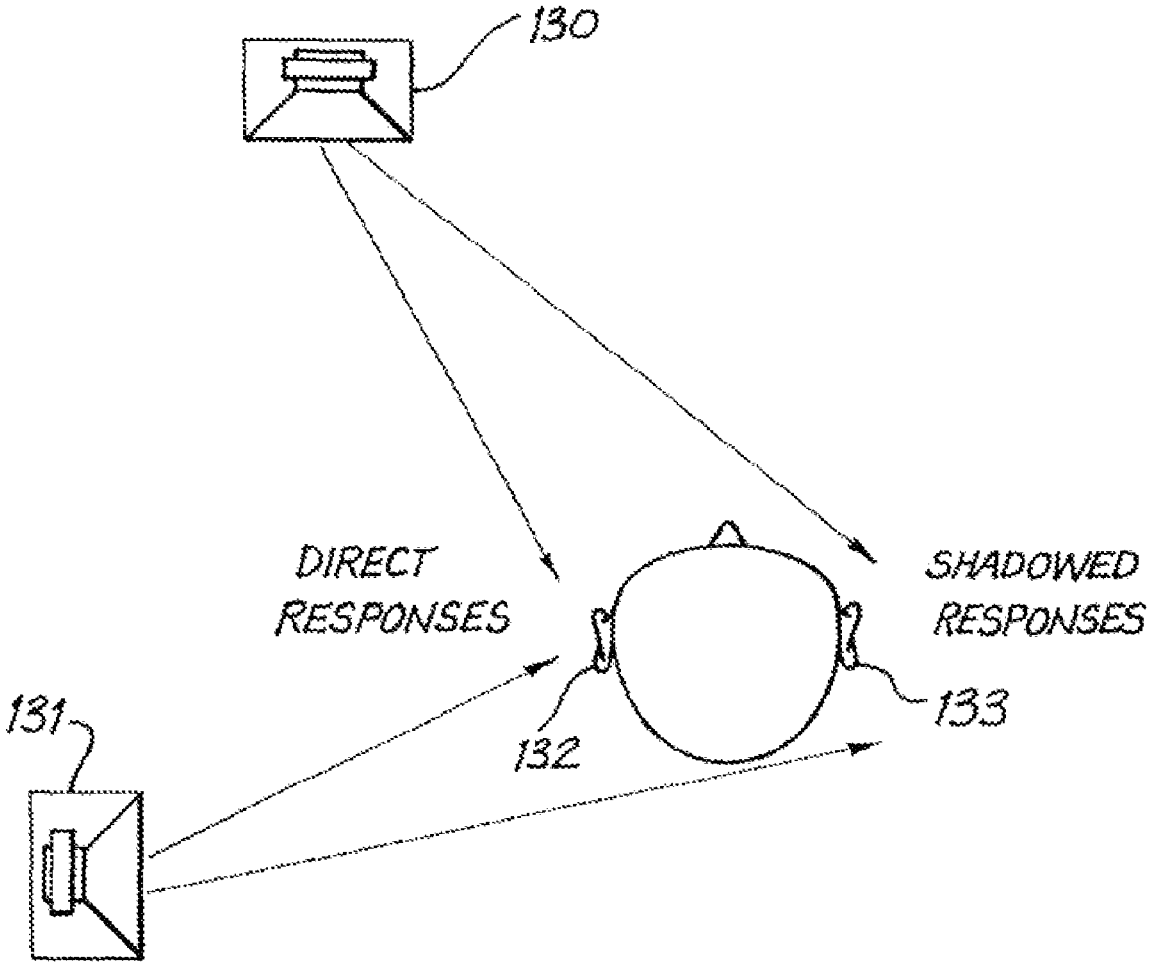
FIG. 10 illustrates the process of calculation of direct and shadowed responses.

Turning now to FIG. 10, in order to better describe the derivation of filter values for the sparse filter reverb FIR 127 of FIG. 9, a number of terms are defined. Firstly, the direct HRTF is defined as the transfer function from a virtual speaker location, 130, 131 to a persons ear 132 which is located on the same side of her head. The shadowed HRTF function is defined as the transfer function from the virtual speaker location e.g., 130, 131 to the person's ear 133 on the opposite side of the head. An actual set of HRTF measurements can be used to approximate the filters.

The frontal HRTFs can be measured from speakers located in front of the listener, 30>to each side. The rear HRTF can be measured from speakers located 120 to either side of the listener. Preferably, the HRTFs are equalized for maximum sound quality with good vocalisation properties.

The front sum filter 128 of FIG. 9 is an approximation of the sum and direct and shadowed frontal HRTF.

Figure 11:
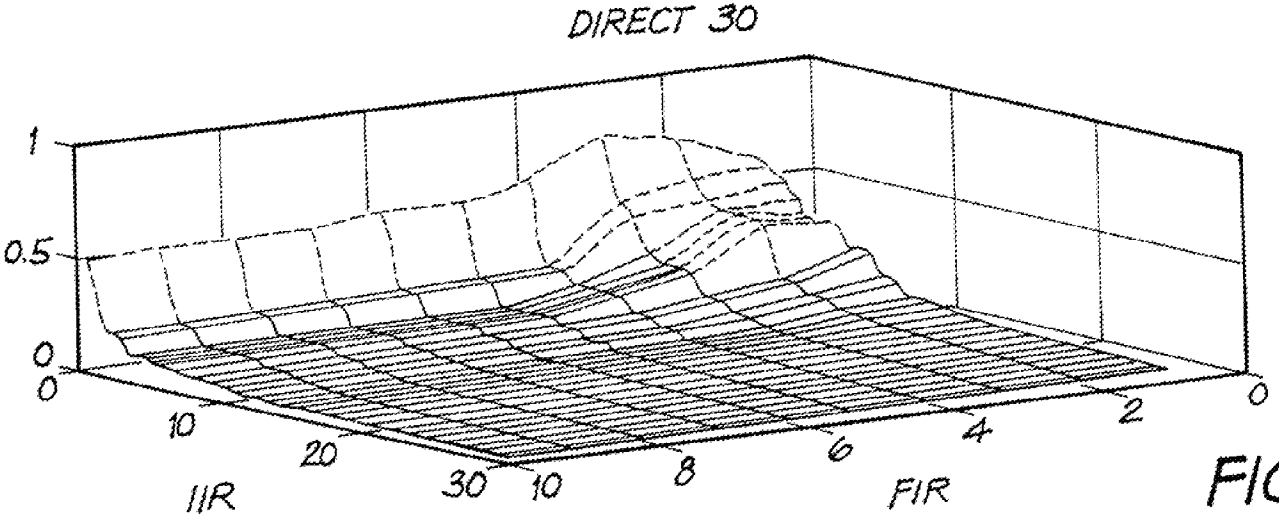
FIG. 11 and FIG. 12 illustrate resultant direct and shadowed responses.
Figure 12:
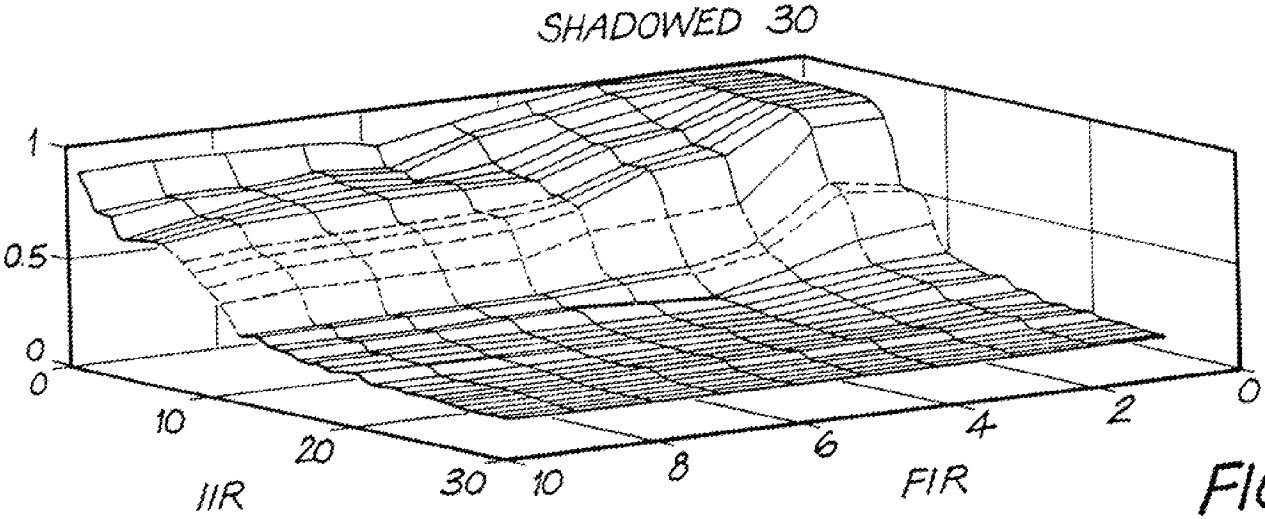

The filter implementation can be a direct form transfer function (FIR) and (IIR) with a substantial FIR component allowing for non-minimum phase transfer function. The system orders can be selected by calculating a grid of approximation error versus FIR and IIR order. The Sum and Difference filters can be approximated with the order set at each point in the grid, then the error in the Direct and Shadowed HRTF plotted—this is shown in FIG. 11 and FIG. 12 for the front direct and shadowed response respectively. Prony analysis was used for the approximation.

The plots exhibit "knee" characteristics demonstrating the significance of a certain order and diminishing returns beyond that. The order for the two frontal filters can be selected based on this information. Effective results were obtained with a FIR order of 14 and an IIR order of 4.

The front difference filter 129 of FIG. 9 can be an approximation of the frontal Direct HRTF minus the frontal Shadowed HRTF. The approximation can be carried out as described in the previous paragraph resulting in an FIR order of 14 and IIR order of 4.

The rear sum filter 119 is an approximation of the rear Direct HRTF plus the rear Shadowed HRTF. The approximation can be carried out as described for the frontal filters. A FIR order of 25 and IIR order of 4 was selected.

The rear difference filter 120 is an approximation of the rear Direct HRTF minus the rear Shadowed HRTF. The approximation can be carried out as described for the frontal filters. A FIR order of 25 and IIR order of 4 was selected.

The reverb filter long delay line 129 is fed with a sum 126 of all the inputs (mono signal). Two sets of sparse tap coefficients are used to create two outputs from this delay line. The delay line 127 can be as long or as short as memory allows. A minimum length of around 300-400 taps is preferred for reasonable results. The sparse tap coefficients are similar in properties but quite different in value. In a first example, the actual taps used were generated by a random process with the following constraints:

No taps are present in the first 300-400 taps. This is to create a gap between the initial HRTF response and the first early echoes. This is to prevent obscuring the spatial location in the initial HRTF.

The taps decrease is amplitude with time. This is to model the attenuation of transmission through air and lossy reflection. The decrease was dithered to provide a degree of randomness. This level of detail is not necessary but for longer filters with many taps it produces much more natural sounding results.

The taps increase in frequency with time. This is to model the increasing density of early echoes as the path length increases and the possible paths to the listener increases.

Figure 13:
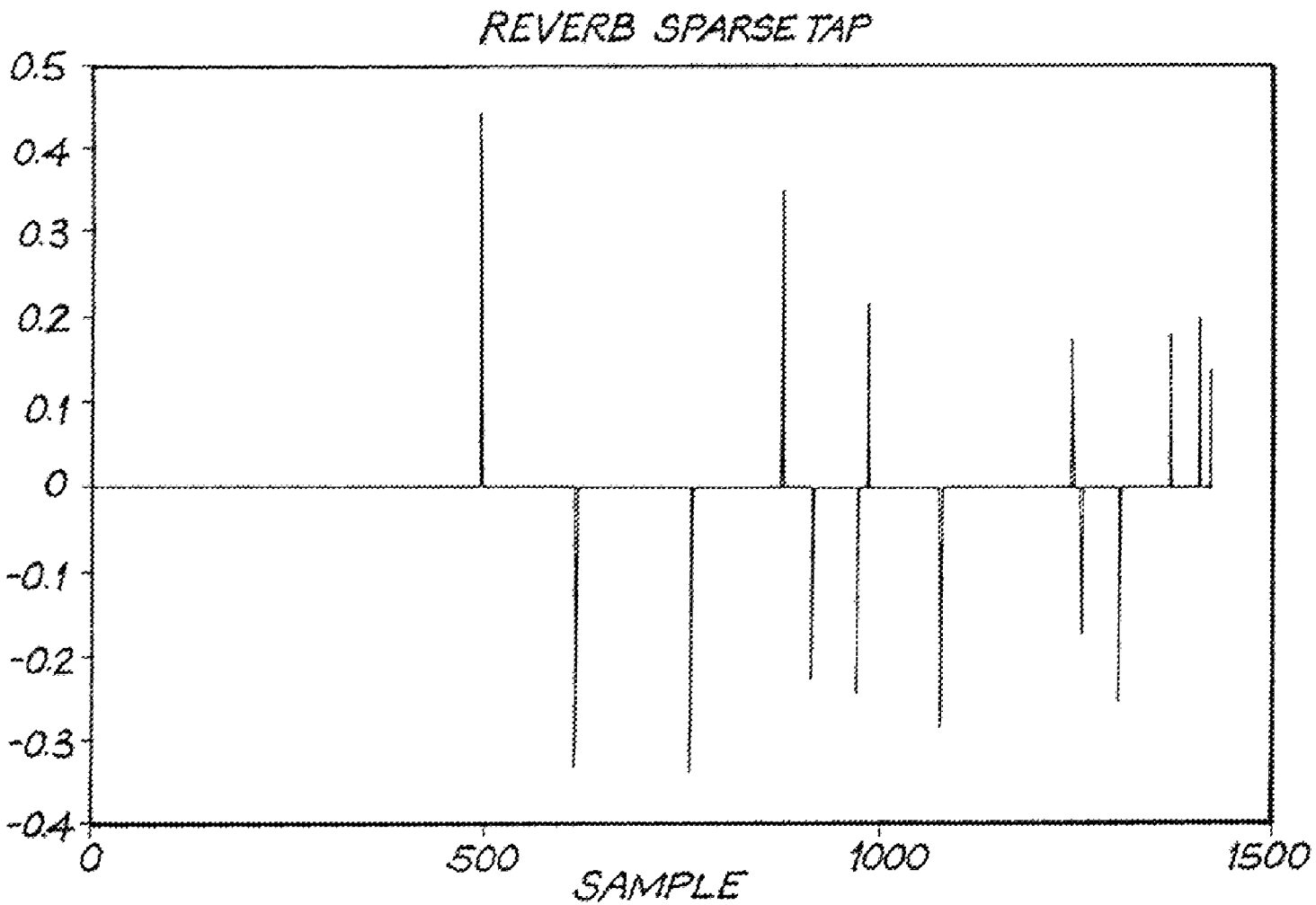
FIG. 13 illustrates a suitable reverb sparse tap.

Several sets of random coefficients were created under these constraints and a set chosen which looked to be evenly spread (not too clustered) and produced a good sound. An example of such a sparse tap filter is shown in FIG. 13.

Other methods and approximations for deriving the sparse tap coefficients may be used but experimentation found this method to be suitable.

The basic property of the reverb filter 127 is to create two uncorrelated outputs which contain information from the mono input signal dispersed in time without significant frequency coloration. Thus the filters could be recursive, reduced sample rate or involve other elaborate processing as memory and compute availability allows.

Figure 14:
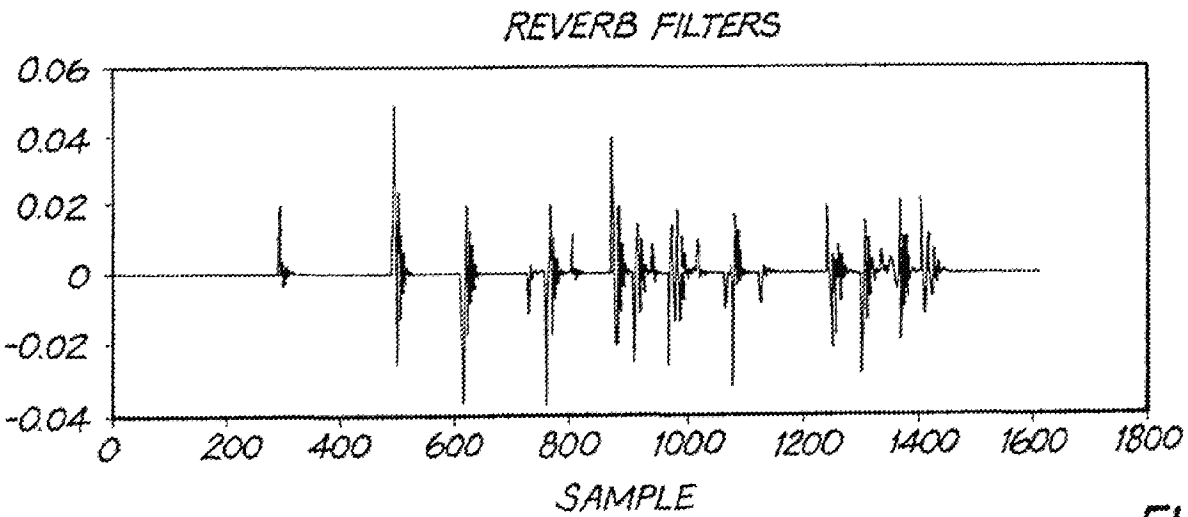
FIG. 14 and FIG. 15 illustrate suitable reverb filters.
Figure 15:
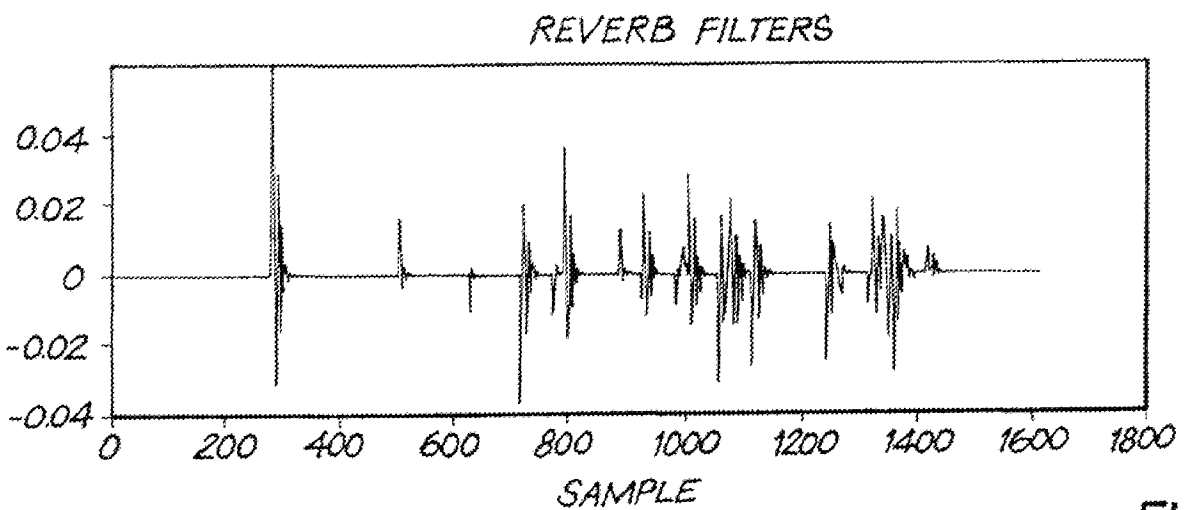

FIG. 14 and FIG. 15 respectively show example the left and right impulse outputs from the reverb filter after passing through the frontal HRTFs. It can be seen that a significant amount of detail is obtained in the output filters for a relatively low amount of computation and memory.

As noted previously, generally, the use of very long FIR filters allows very accurate simulation of 3-D acoustic spaces to be achieved, but requires large memories to store the audio data and filter coefficients. In contrast, recursive (IIR) filter structures require much less memory, and often also less processing power, and can be used to implement reverberant-like filter responses. Unfortunately, the enormous reduction in memory storage used in an IIR reverberator can result in a much less convincing 3-D acoustic impression.

One approach taken in the creation of 3-D binaural audio signals is to apply higher-quality processing (using higher order filter structures) for the early part of the simulated acoustic response. In this way, the processing of the direct sound (the simulation of the signal path from a virtual loudspeaker directly to the listener) and some number of early reflections will be implemented using a separate pair of filters for each sound arrival. In each pair, one filter is operating to produce the left ear response, and one filter is operating to produce the right ear response.

Figure 16:
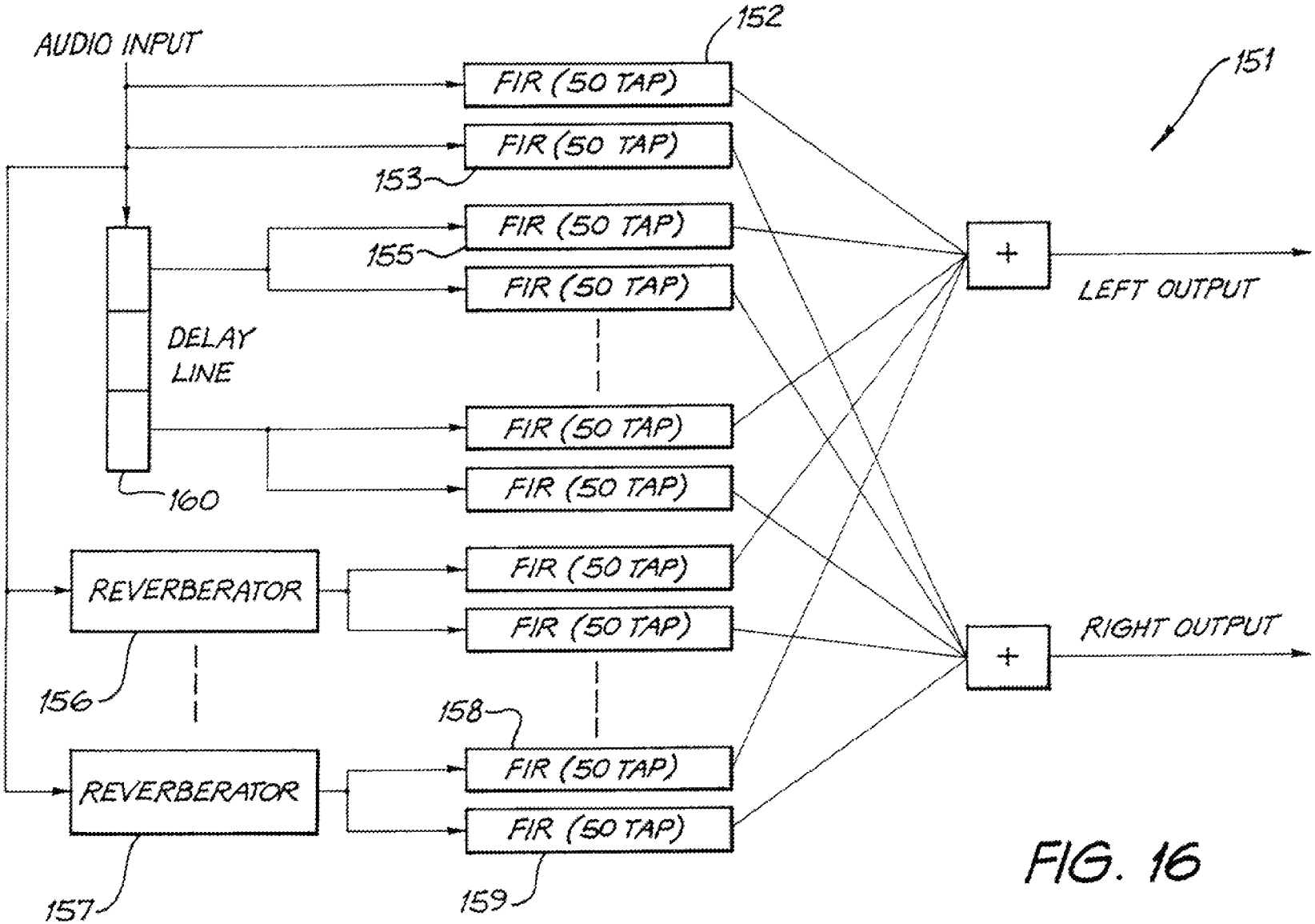
FIG. 16 illustrates a method of implementing binauralization.

FIG. 16 shows a further example of an implementation. In this example system, the head-related transfer functions (HRTFs) are all implemented using pairs of 50-tap FIR filters. The two uppermost filters 152, 153 in FIG. 16 process the input audio so as to simulate the direct sound arrival at the two ears of the listener. The pairs of FIR filters e.g., 5 that are attached to the Delay Line 160 process the delayed input audio so as to simulate the arrival of early echoes in the virtual room, at the two ears of the listener. Finally, the reverberators e.g., 156, 157 generate several uncorrelated reverberation signals that are each individually binauralized by the pairs of FIR filters 158, 159 that take their inputs from the reverberators.

In this example, the impression of a diffuse 3-D reverberation field is achieved by using multiple reverberators e.g., 156, 157 (usually implemented with recursive filter structures), each processed though a different HRTF FIR filter, e.g., 158,159 arranged so that the collection of HRTF FIR filters covers a broad spread of incident angles around the listener.

In practice, the implementation of a system such as that shown in FIG. 16 may use different FIR filter lengths in each FIR filter. A large portion of the total processing requirement may be consumed in the implementation of these FIR filters, and shorter approximated HRTFs may be used when possible, as a means to improving the efficiency of the algorithm.

The HRTF filters do not need to be longer than about 4 ms in duration. The use of 50-tap filters (assuming a sample rate of 48 kHz) is by way of example only.

Figure 17:
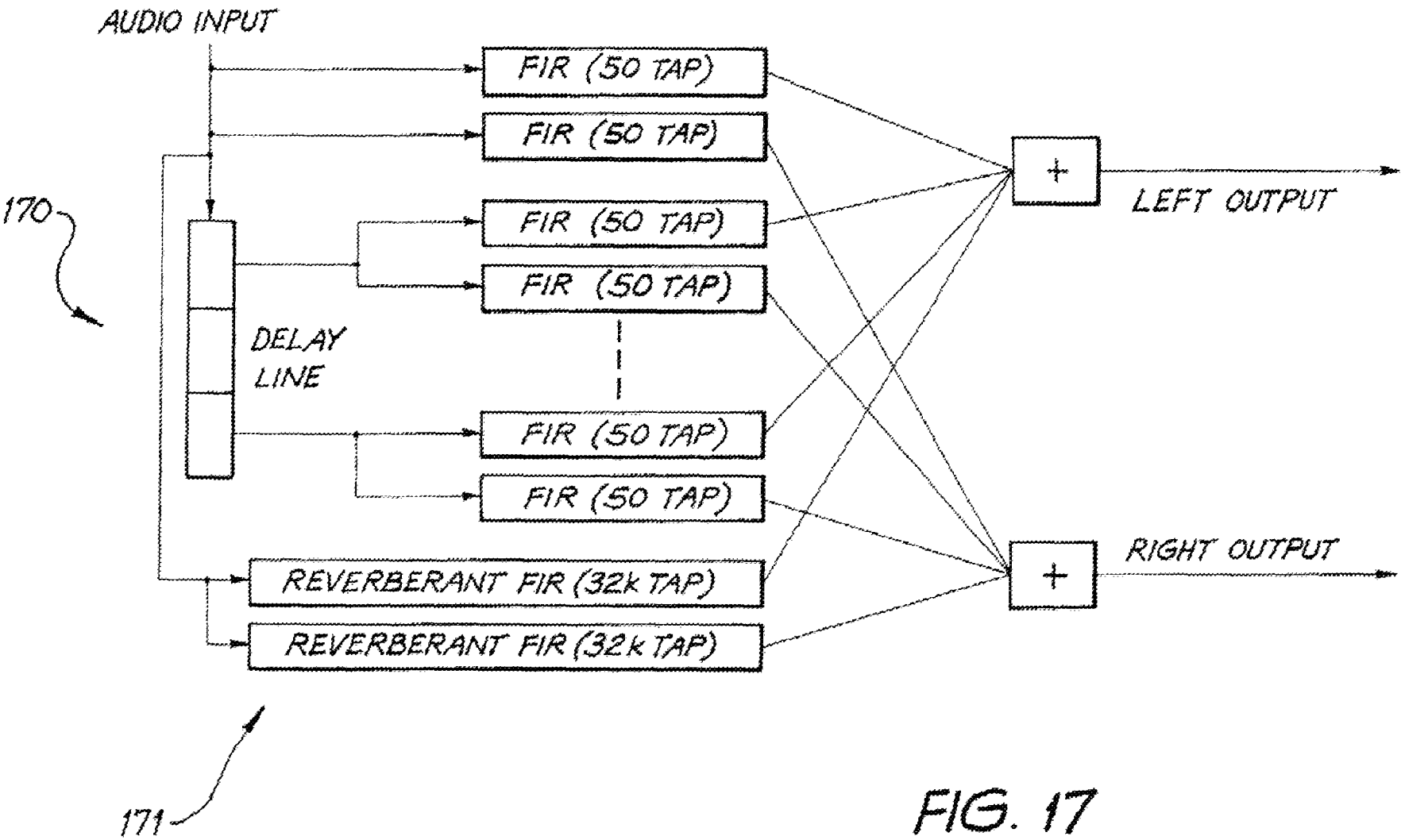
FIG. 17 illustrates a second known method of implementing of binauralization.

FIG. 17 shows an alternative implementation 170 of a 3-D sound processing system where the late reverberant part is implemented using a pair of long FIR filters 171. In this example (assuming a 48 kHz sample rate) the 32 k Tap FIR filters will allow acoustic spaces to be simulated with reverberation times of up to 670 ms.

By making use of real, measured binaural acoustic responses, the Reverberant FIR filters 171 in FIG. 17 can provide a much more accurate 3-D acoustic impression than the recursive reverberation structures used in FIG. 16.

The long FIR filters used in the reverberant filters in FIG. 17 may be implemented efficiently using techniques such as those described in U.S. Pat. No. 5,502,747 assigned to the present applicant. Whilst the computational efficiency required in the implementation of these filters may be reduced by using such techniques, the memory requirement is still very high.

A further embodiment describes a class of reverberator, intended for production of binaural reverberation, in which a long impulse response is created using a recursive filter, and the binaural characteristics are imparted through the use of a pair of medium length FIR filters.

Figure 18:
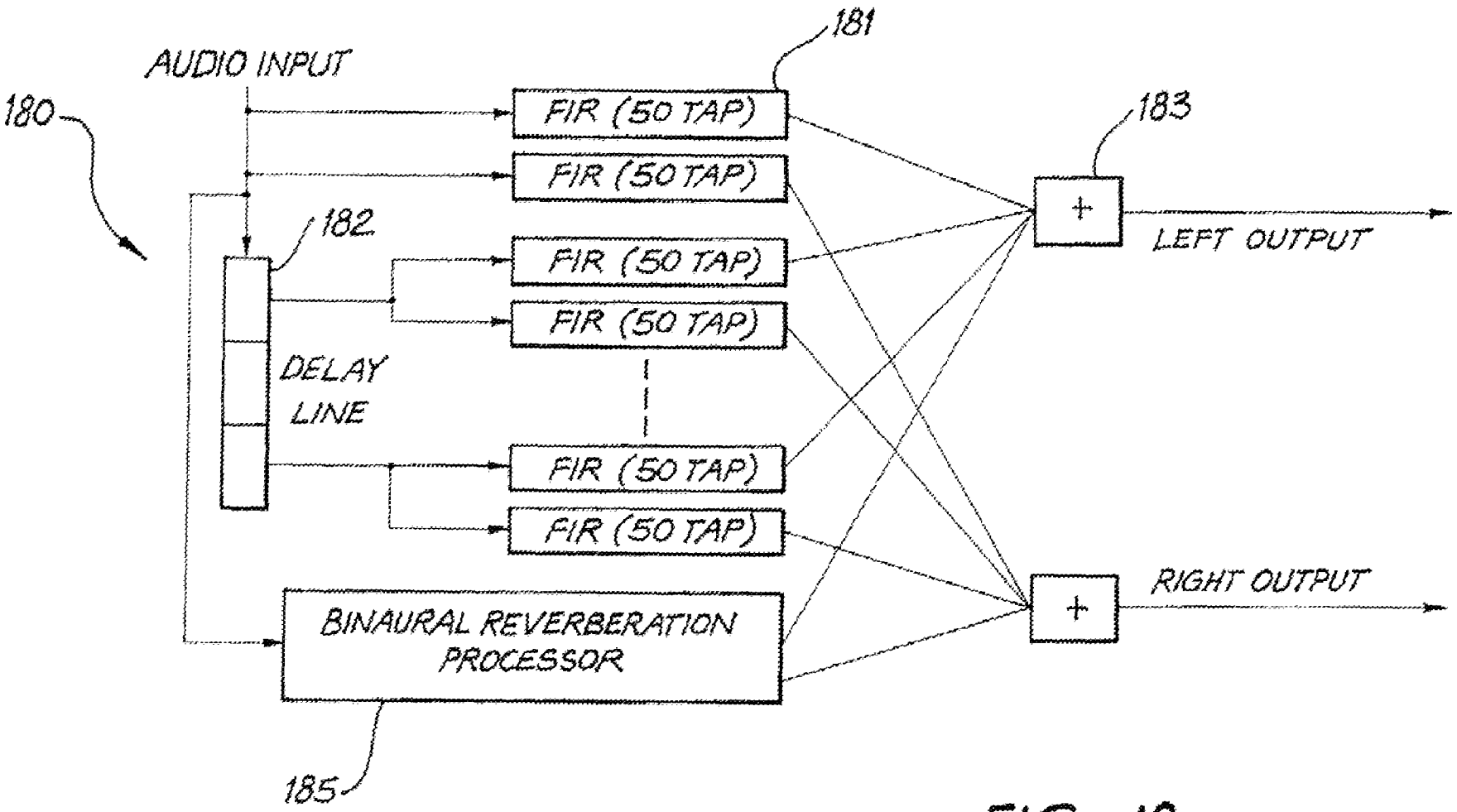
FIG. 18 illustrates the basic overall structure a further embodiment.

FIG. 18 shows the general structure of a further embodiment 180. As described earlier, the FIR filters e.g., 181, delay lines 182, and summing elements 183 are included for the purpose of simulating the direct sound and early echoes. The medium to late reverberant part of the 3-D acoustic response is provided by a Binaural Reverberation Processor 185.

Some desirable properties of the Binaural Reverberation Processor 185 are:

The cross-correlation between the left and right channel impulse responses of the Binaural Reverberation Processor 185 should exhibit the same approximate characteristics as that of a real (measured) binaural room response. This should, preferably, include a time varying cross-correlation, as occurs when the lateral energy component of the reverberant response grows in the later part of the room response of some acoustic spaces.

The spectral density of the reverberant response should follow the same approximate time-contour as that of a real (measured) binaural room response. This problem is already solved in most recursive reverberation processors in use today, as the recursive filter loop(s) act to attenuate high frequencies more rapidly than low frequencies (for example) to simulate air absorption and other effects.

Figure 19:
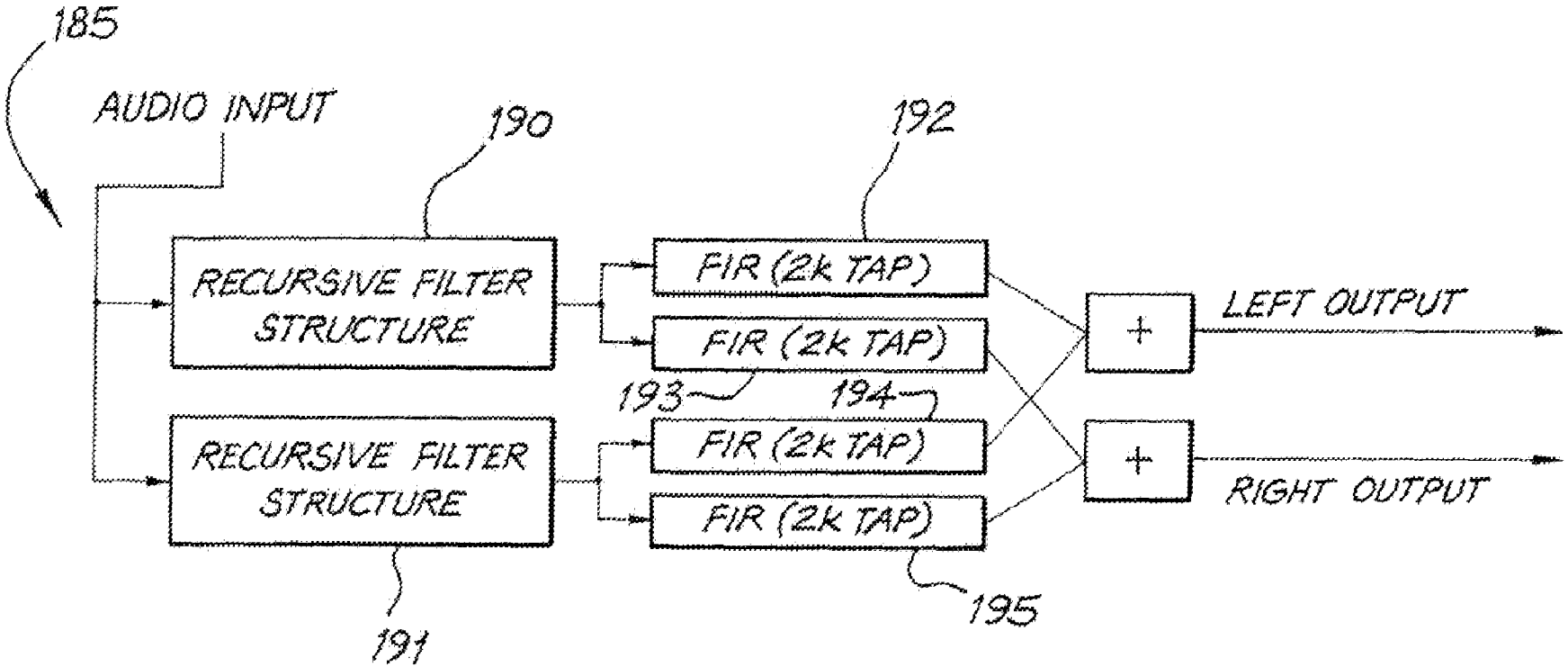
FIG. 19 illustrates a first implementation of the binaural reverberation process of FIG. 18.

Several alternative structures are proposed for the implementation of the Binaural Reverberation Processor 185. FIG. 19 shows one preferred arrangement.

In principle, a single recursive filter might be used to generate the desired decaying reverberation profile of an acoustic space, and a single pair of FIR filters may be used add the diffuse binaural characteristic to the left and right outputs. However, in practice, any perceptually significant inter-channel amplitude imbalances or frequency response irregularities in the FIR filters will be noticeable in the output of the system. For this reason, multiple recursive filter structures, 191 (each with it's own binaural pair of FIR filters e.g., 192, 193) are used, to provide a more random binaural response.

In a further embodiment of the invention, the two Recursive Filter Structures of FIG. 19 are adapted so that the upper Recursive Filter Structure 190 has a longer reverberation decay time than the lower Recursive Filter Structure 191. In this case, the binaural characteristics of the lower FIR filter pair 194, 195 will dominate the system's response in the early part of the reverberant decay, and the binaural characteristics of the upper filter pair 192, 193 will dominate the system's response in the later part of the reverberant decay.

Figure 20:
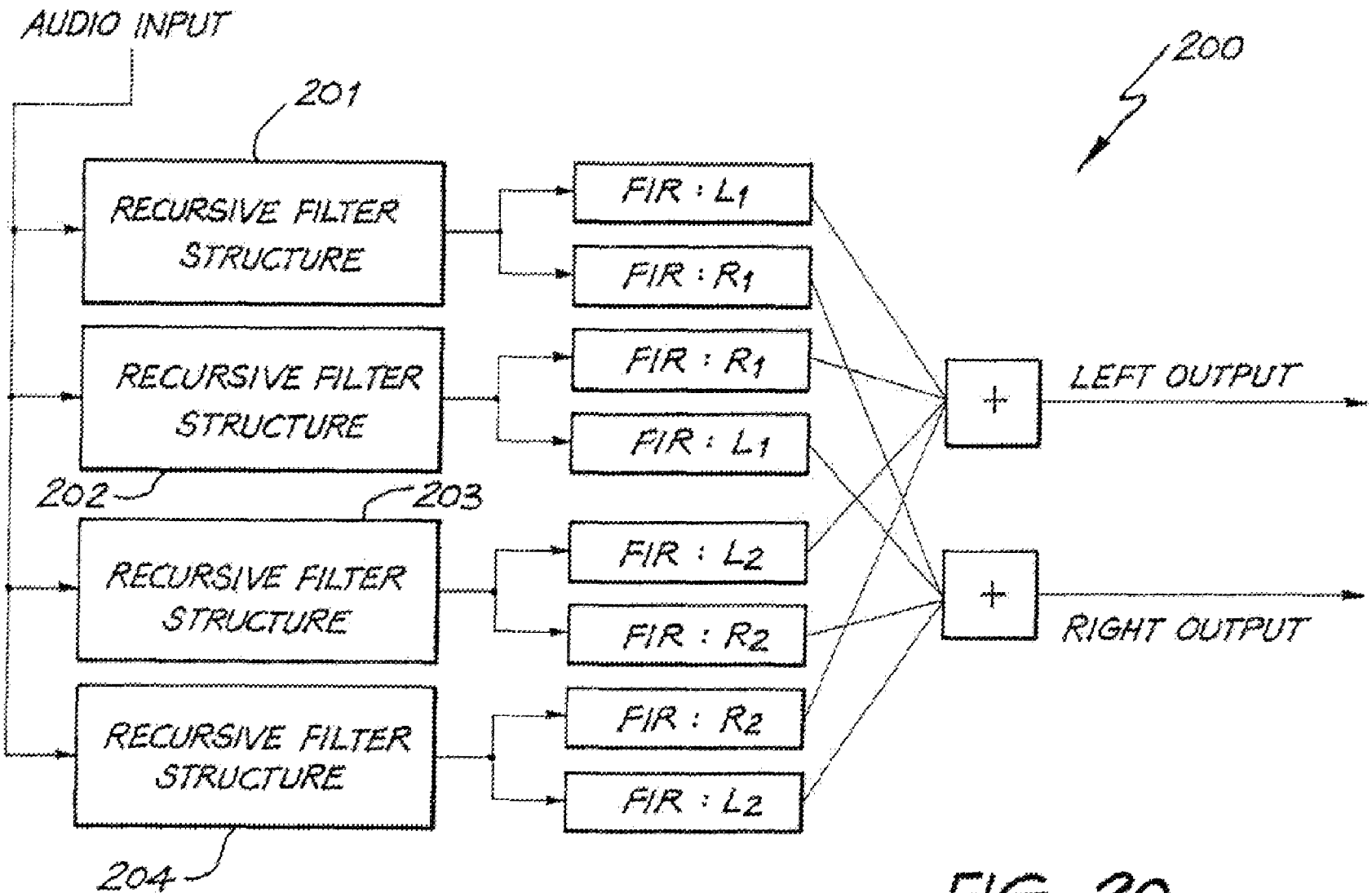
FIG. 20 illustrates an alternative form of implementation of the binaural reverberation processors.

A further embodiment is illustrated 200 in FIG. 20, this time showing a larger number of Recursive filter structures 201-204. In the system 200 shown in FIG. 20, any possible imbalances between the left and right filter coefficients used in the FIR filters are corrected by using each binaural filter pair alongside it's mirror image (the same binaural pair of filters with left and right filter transfer functions exchanged).

Figure 21:
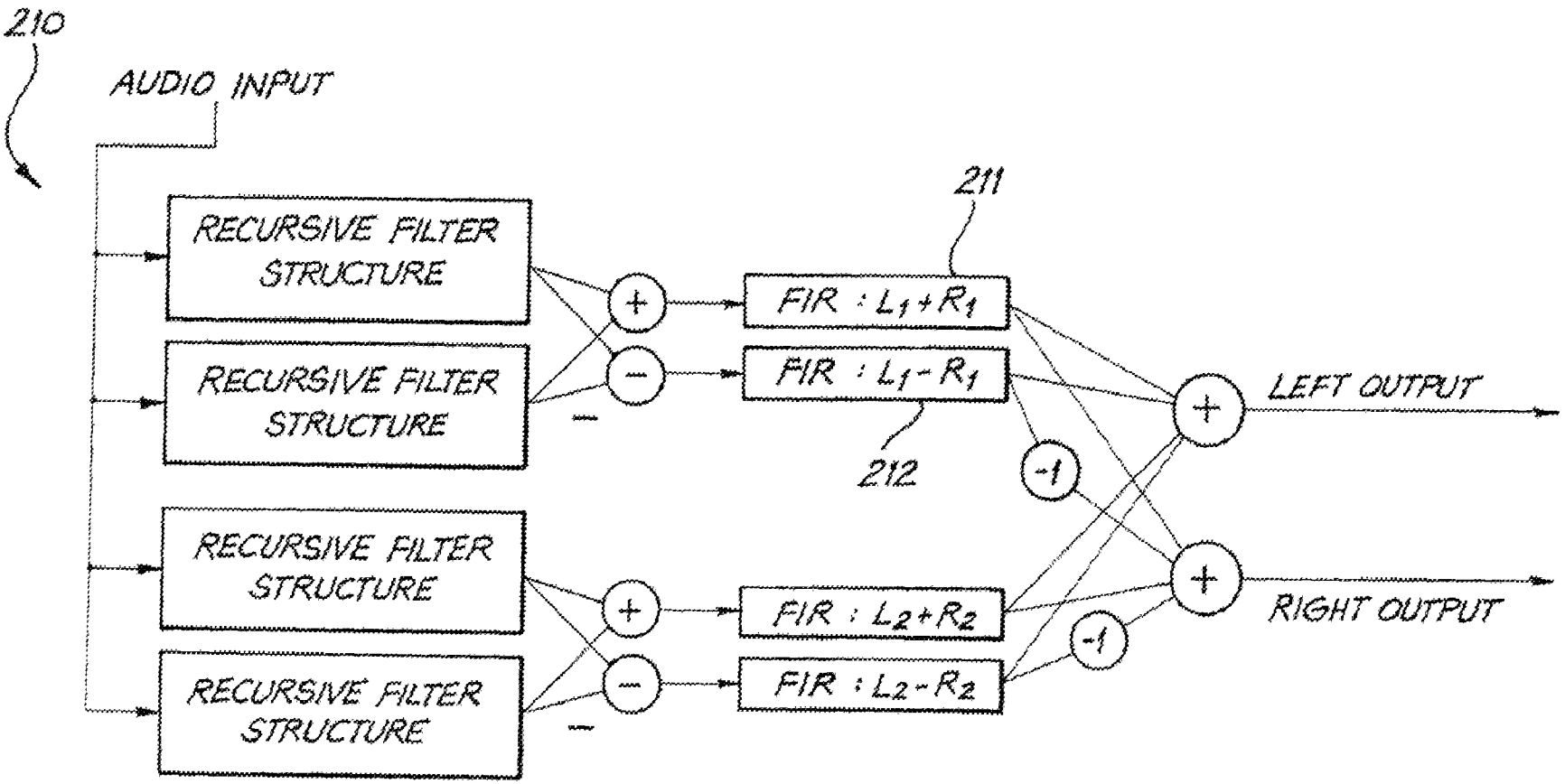
FIG. 21 illustrates a further alternative form of implementation of the binaural reverberation processor.

In a further arrangement 210 shown in FIG. 21, two mirror-image pairs of FIR filters are implemented using a single pair of Sum e.g., 211 and Difference 212 filters. This reduces the FIR computation effort significantly.

Figure 22:
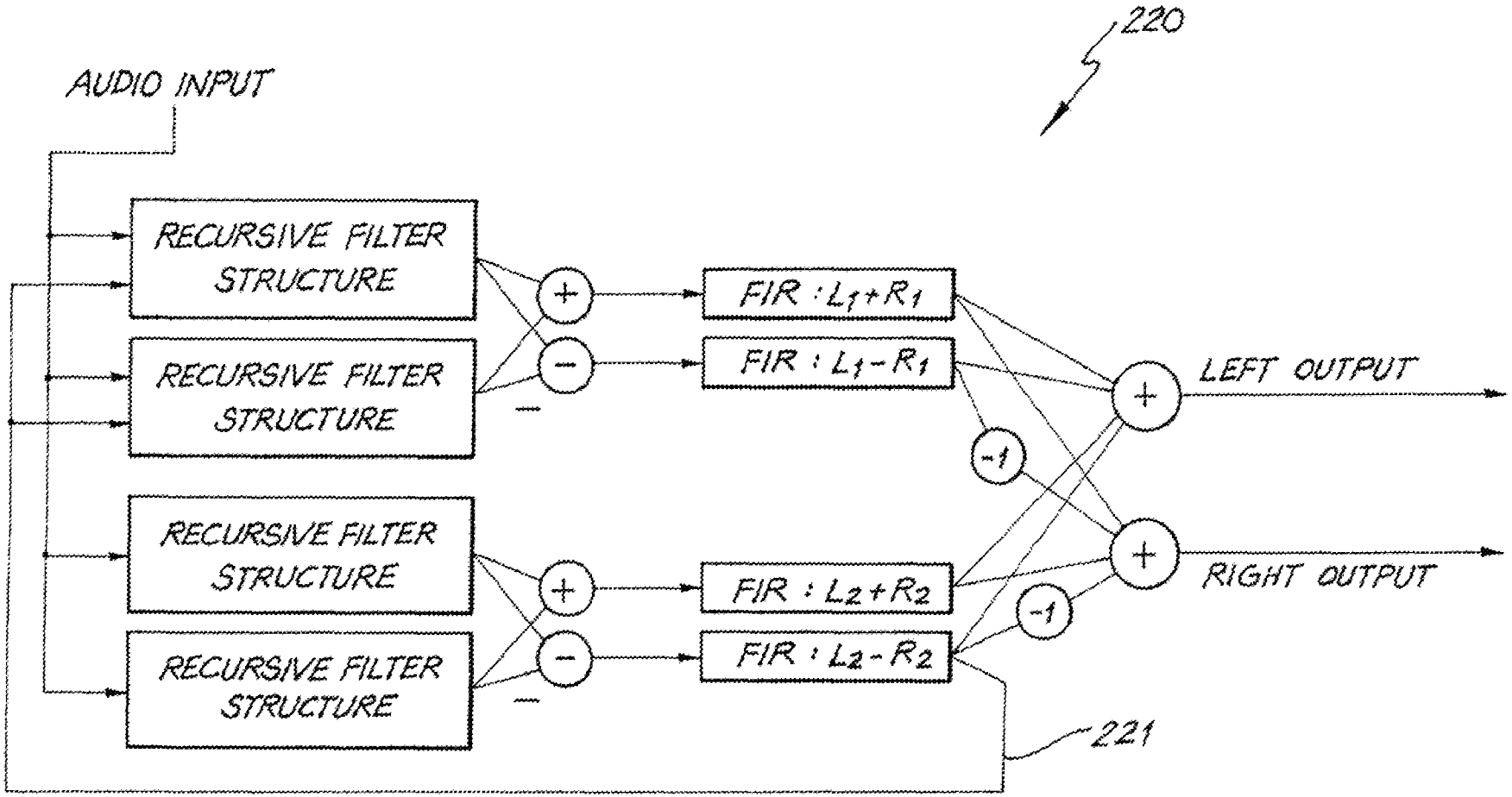
FIG. 22 illustrates the utilization of feedback in a further alternative implementation of the binaural reverberation processor.

A further modified embodiment 220 is shown in FIG. 22, wherein the output 221 of one of the FIR filters is fed back into one or more of the Recursive Filter Structures. This feedback path 221 enables more dense reverberation filters to also be implemented.

As noted previously the discussed embodiments takes a stereo input signal or, alternatively, where available, a digital input signal or surround sound input signal such as Dolby Prologic, Dolby Digital (AC-3 ) and DTS, and uses one or more sets of headphones for output. The input signal is binaurally processed so as to improve listening experiences through the headphones on a wide variety of source material thereby making it sound "out of head" or to provide for increased surround sound listening.

Given such a processing technique to produce an out of head effect, a system for undertaking processing can be provided in a number of different forms. For example, many different possible physical embodiments are possible and the end result can be implemented utilizing either analog or digital signal processing techniques or a combination of both.

In a purely digital implementation, the input data is assumed to be obtained in digital time-sampled form.

If the embodiment is implemented as part of a digital audio device such as compact disc (CD), MiniDisc, digital video disc (DVD) or digital audio tape (DAT), the input data will already be available in this form. If the unit is implemented as a physical device in its own right, it may include a digital receiver (SPDIF or similar, either optical or electrical). If the invention is implemented such that only an analog input signal is available, this analog signal must be digitised using an analog to digital converter (ADC).

This digital input signal is then processed by a digital signal processor (DSP) programmed to carry out the chosen filtering and mixing effects. Examples of DSPs that could be used are:

1. A semi-custom or full-custom integrated circuit designed as a DSP dedicated to the task.
2. A programmable DSP chip, for example the Motorola DSP56002.
3. One or more programmable logic devices.

In a typical implementation the processing may involve the following main building blocks:

1. Convolution with filter characteristics derived from measured or synthesised Head Related Transfer Functions (HRTFs) using low latency techniques such as those described in U.S. Pat. No. 5,502,747 assigned to the present applicant.
2. Recursive filtering using Infinite Impulse Response (IIR) approximations on all or part of impulse responses derived from measured or synthesised HRTFs.
3. "Sparse tap" Finite Impulse Response (FIR) or IIR reverberation filters to simulate the late reflections present in a typical listening environment with speakers. A sparse tap FIR filter refers to one where most of the coefficients are zero and therefore do not need to be calculated.
4. In the case where the embodiment is to be used with a specific set of headphones, filtering may be applied to compensate for any unwanted frequency response characteristics of those headphones.

After processing, the stereo digital output signals are converted to analog signals using digital to analog converters (DAC), amplified if necessary, and routed to the stereo headphone outputs, perhaps via other circuitry.

This final stage may take place either inside the audio device in the case that an embodiment is built-in, or as part of the separate device should an embodiment be implemented as such.

The ADC and/or DAC may also be incorporated onto the same integrated circuit as the processor. An embodiment could also be implemented so that some or all of the processing is done in the analog domain.

Embodiments preferably have some method of switching the "binauraliser" effect on and off and may incorporate a method of switching between equaliser settings for different sets of headphones or controlling other variations in the processing performed, including, perhaps, output volume.

In one embodiment, the processing steps are incorporated into a portable CD or DVD player as a replacement for a skip protection IC. Many currently available CD players incorporate a "skip-protection" feature which buffers data read off the CD in random access memory (RAM). If a "skip" is detected, that is, the audio stream is interrupted by the mechanism of the unit being bumped off track, the unit can reread data from the CD while playing data from the RAM. This skip protection is often implemented as a dedicated DSP, either with RAM on-chip or off-chip.

Figure 23:
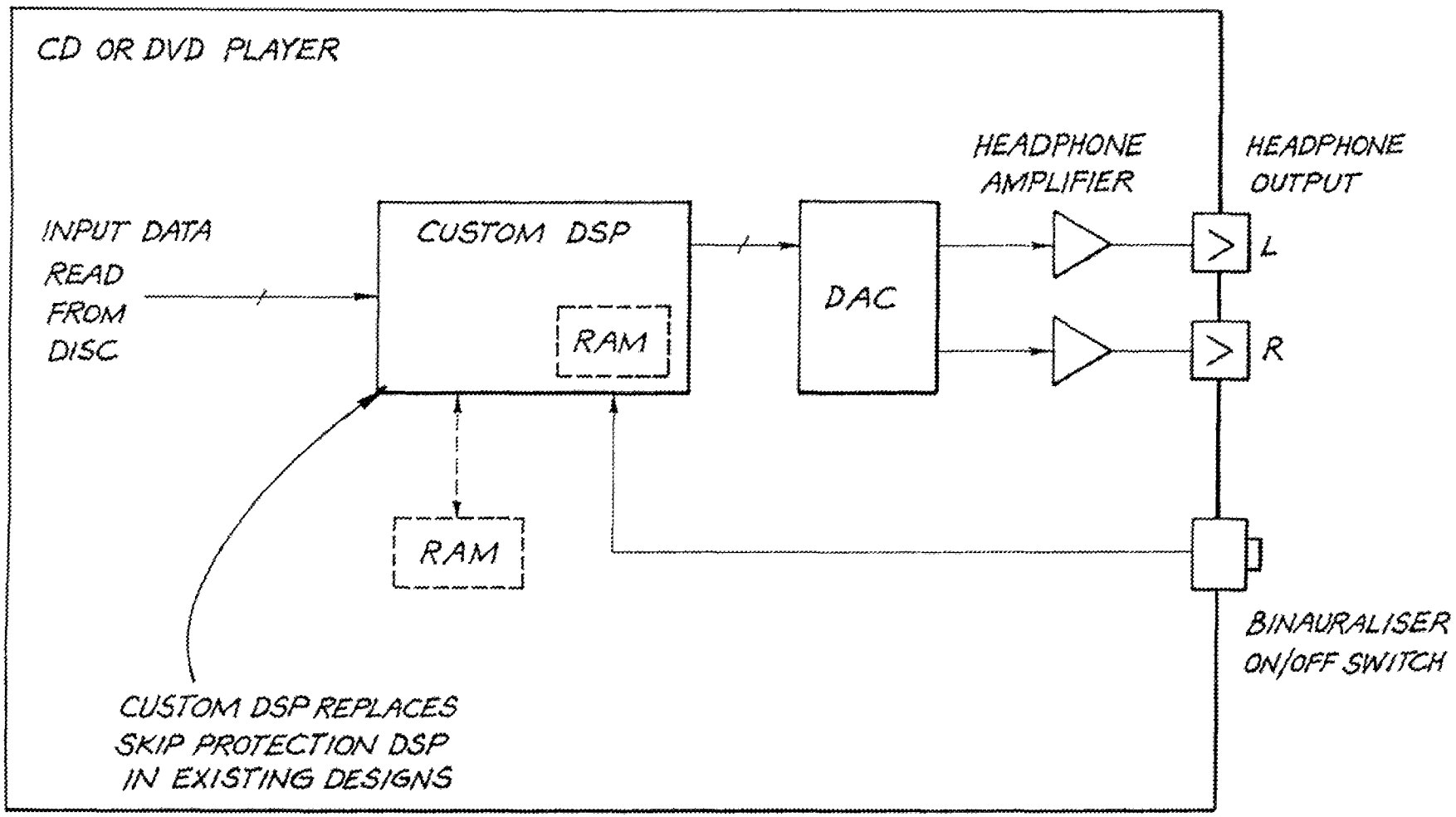
FIG. 23 illustrates an embodiment comprising a binauraliser replacement for a skip protection DSP in a CD or DVD player.

This embodiment is implemented such that it can be used as a replacement for the skip protection processor with a minimum of charge to existing designs. In this implementation can most probably be implemented as a fullcustom integrated circuit, fulfilling the function of both existing skip protection processors and implementation of the out of head processing. A part of the RAM already included for skip protection could be used to run the out of head algorithm for HRTF-type processing. Many of the building blocks of a skip protection processor would also be useful in for the processing described for this invention. An example of such an arrangement is illustrated in FIG. 23.

Figure 24:
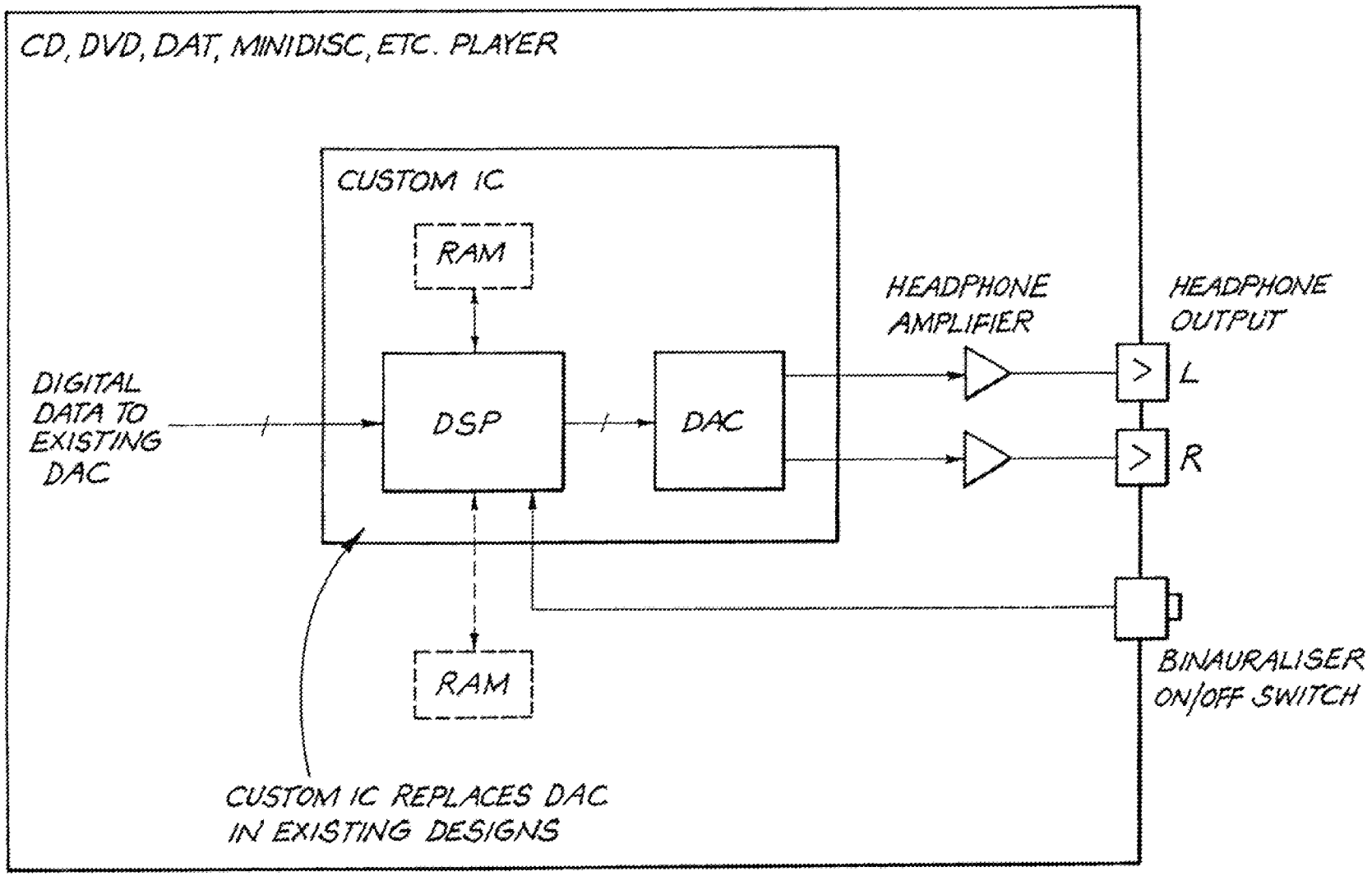
FIG. 24 illustrates an embodiment comprising a binauraliser replacement for digital to analog converter in a digital audio device.

In a further embodiment illustrated in FIG. 24 the processing is incorporated into a digital audio device (such as a CD, MiniDisc, DVD or DAT player) as a replacement for the DAC. In this implementation the signal processing is performed by a dedicated integrated circuit incorporating a DAC. This can easily be incorporated into a digital audio device with only minor modifications to existing designs as the integrated circuit can be virtually pin compatible with existing DACs.

Figure 25:
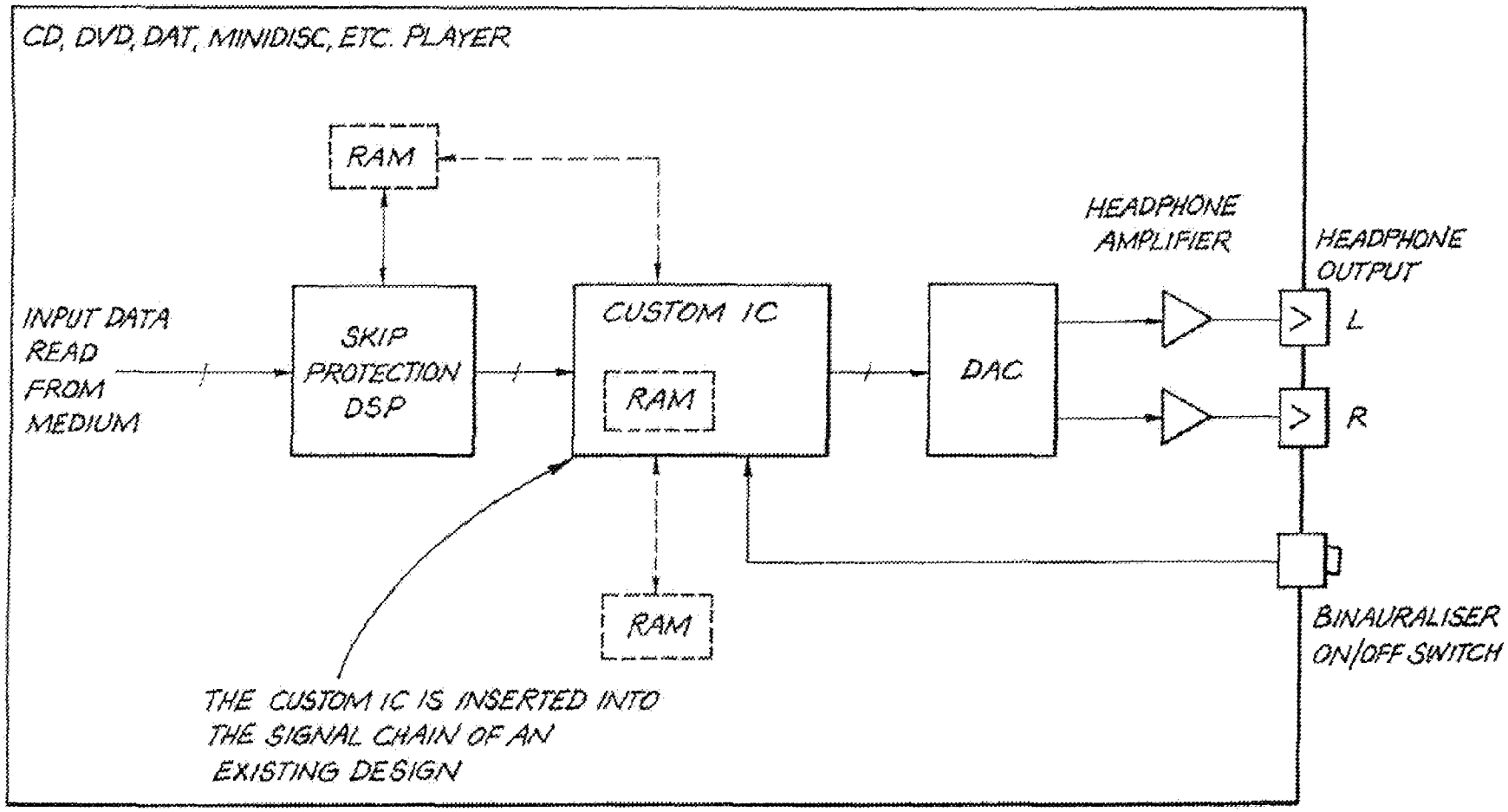
FIG. 25 illustrates an embodiment comprising the incorporation of a binauraliser into a digital audio device.

In a further embodiment, illustrated in FIG. 25, the processing is incorporated into a digital audio device (such as a CD, MiniDisc, DVD or DAT player) as an extra stage in the digital signal chain. In this implementation the signal processing would be performed by either a dedicated or programmable DSP mounted inside a digital audio device and inserted into the stereo digital signal chain before the DAC.

Figure 26:
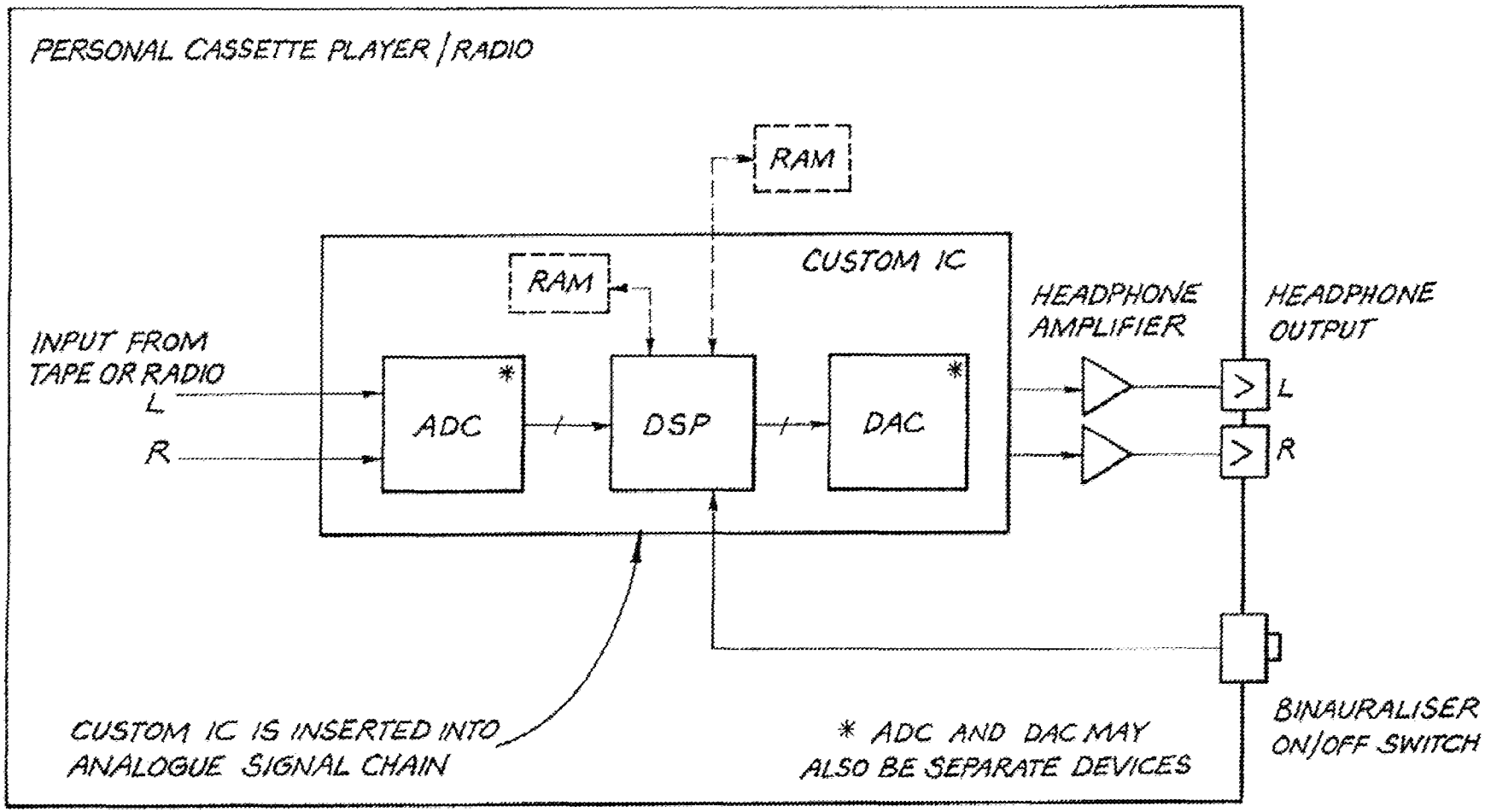
FIG. 26 illustrates an embodiment comprising the incorporation of a binauraliser into an analog audio device.

In a further embodiment, illustrated in FIG. 26, the processing is incorporated into an audio device (such as a personal cassette player or stereo radio receiver) as an extra stage in the analog signal chain. This embodiment uses an ADC to make use of the analog input signals. This embodiment can most likely be fabricated on a single integrated circuit, incorporating a ADC, DSP and DAC. It may also incorporate some analog processing. This could be easily added into the analog signal chain in existing designs of cassette players and similar devices.

Figure 27:
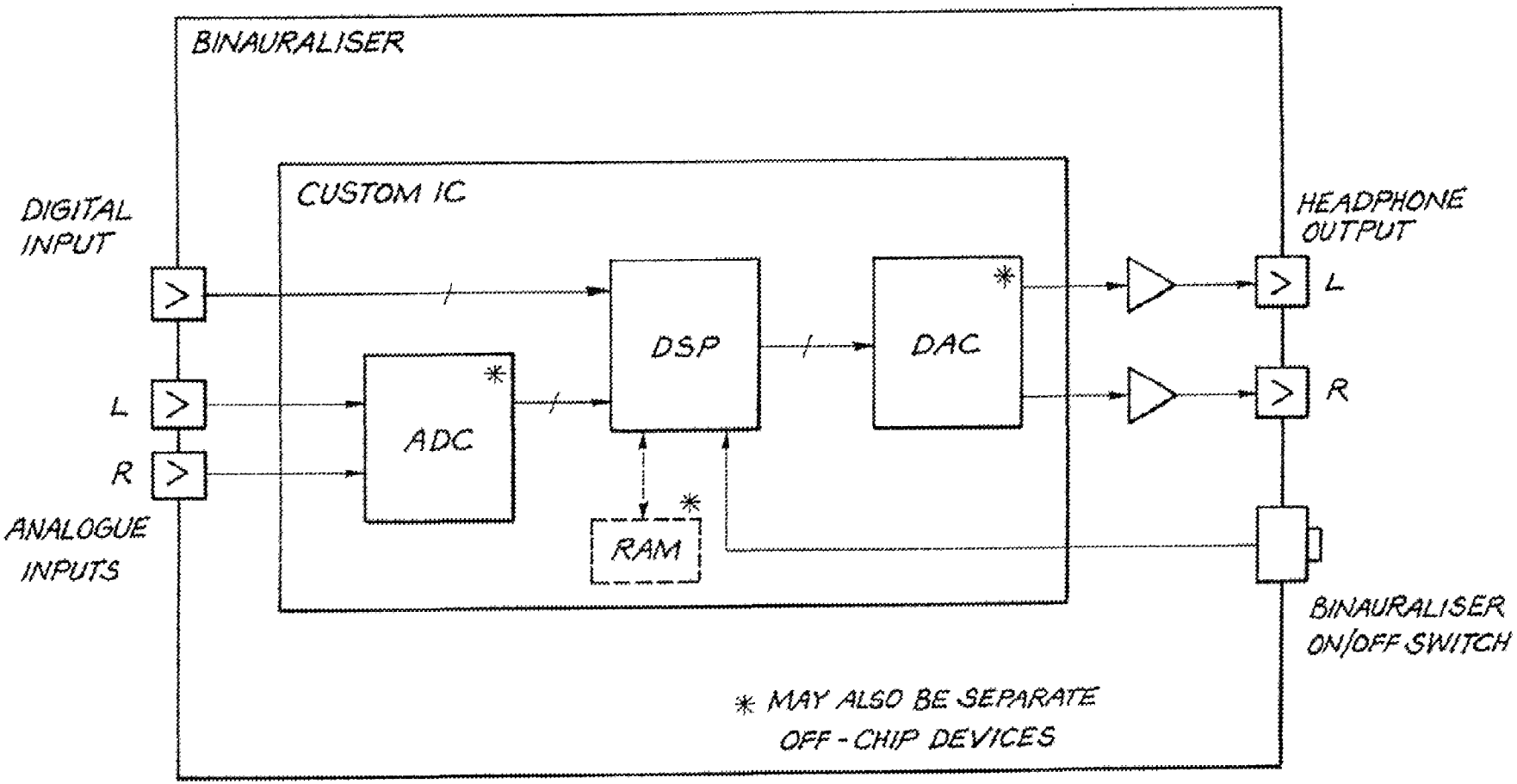
FIG. 27 illustrates a stand alone binauraliser.

In a further embodiment, illustrated in FIG. 27, the processing is implemented as an external device for use with stereo input in digital form. The embodiment can be as a physical unit in its own right or integrated into a set of headphones as described earlier. It can be battery powered with the option to accept power from an external DC plugpack supply. The device takes digital stereo input in either optical or electrical form as is available on some CD and DVD players or similar. Input formats can be SPDIF or similar and the unit may support surround sound formats such as Dolby Digital AC-3, DTS. It may also have analog inputs as described below. Processing is performed by some form of DSP. This is followed by a DAC. If this DAC can not directly drive headphones, an additional amplifier is added after the DAC. This embodiment of the invention may be implemented on a custom integrated circuit incorporating DSP, DAC, and possibly headphone amplifier.

Alternatively, the embodiment can be implemented as a physical unit in its own right or integrated into a set of headphones. It is battery powered with the option to accept power from an external DC plugpack supply.

The device takes analog stereo input which is converted to digital data via an ADC. This data is then processed using a DSP and converted back to analog via a DAC. Some or all of the processing may instead by performed in the analog domain. This implementation could be fabricated onto a custom integrated circuit incorporating ADC, DSP, DAC and possibly a headphone amplifier as well as any analog processing circuitry required. The embodiment may incorporate a distance or "zoom" control which allows the listener to vary the perceived distance of the sound source.

In a further embodiment this control is implemented as a slider control. When this control is at its minimum the sound appears to come from very close to the ears and may, in fact, be plain unbinauralized stereo. At this control's maximum setting the sound is perceived to come from a distance. The control can be varied between these extremes to control the perceived "out-of-head"-ness of the sound. By starting the control in the minimum position and slider it towards maximum, the user will be able to adjust to the binaural experience quicker than with a simple binaural on/off switch.

Figure 28:
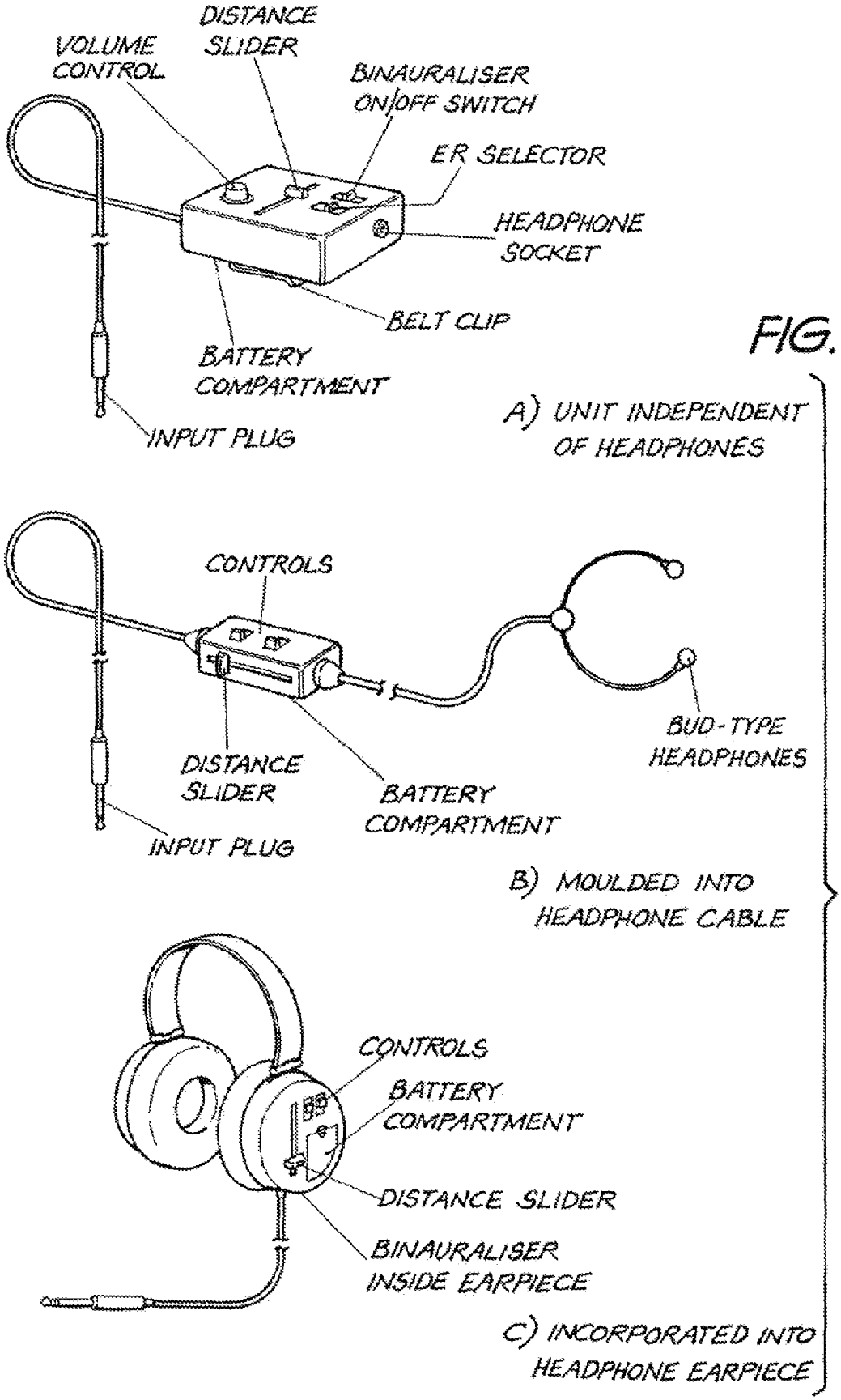
FIG. 28 illustrates various possible physical implementations of a stand alone binauraliser.

Implementation of such a control can comprise utilizing different sets of stored filter responses measured with the placement of sources at different distances with the processor changing the current set of filter coefficients in accordance with the current zoom control position or setting. Example implementations are shown in FIG. 28.

As a further alternative, an embodiment could be implemented as generic integrated circuit solution suiting a wide range of applications including those set out previously.

The embodiment can be implemented as an integrated circuit incorporating some or all of the building blocks mentioned in the above implementations. This same integrated circuit could be incorporated into virtually any piece of audio equipment with headphone output. It would also be the fundamental building block of any physical unit produced specifically as an implementation of the invention. Such an integrated circuit would include some or all of ADC, DSP, DAC, memory 12S stereo digital audio input, S/PDIF digital audio input, headphone amplifier as well as control pins to allow the device to operate in different modes (e.g., analog or digital input).

It would be appreciated by a person skilled in the art that numerous further variations and/or modifications may be made to the present invention as shown in the specific embodiments without departing from the spirit or scope of the invention as broadly described. The present embodiments are, therefore, to be considered in all respects to be illustrative and not restrictive.

We claim:

1. An apparatus including a programmable processor or a semi-custom or full-custom dedicated processor, or one or more programmable logic devices, said apparatus for creating, utilizing a pair of oppositely opposed headphones, the sensation of a sound source being spatially distant from the area between said pair of headphones, said apparatus comprising:

(a) a set of audio input terminals configured to accept a set of audio inputs representing audio signals each being projected from an idealized sound source located at a respective spatial location relative to an idealized listener, the set of audio inputs including at least a left audio input and a right audio input;

(b) a first mixing matrix means interconnected to said audio terminals and one or more feedback inputs and configured to output a first predetermined combination of said audio inputs and said one or more feedback inputs as intermediate output signals and to output a sum of said audio inputs;

(c) a filter system including:

(i) one or more filters to filter said intermediate output signals and to output filtered intermediate output signals to account for the direct response of a room, and;

(ii) one or more filters for feedback response filtering said sum and to output said feedback inputs to account for a non-directional approximation to the reverberant response of the room, wherein said feedback inputs are non-directional such that the filtered intermediate output signals include filtered direct response signals and filtered reverberant signals that also account for the direct response, wherein said feedback inputs are non-directional; and (d) a second matrix mixing means combining said filtered intermediate output signals to produce left and right channel stereo outputs.

2. An apparatus as claimed in claim 1 wherein a predetermined number of said feedback inputs are also input to said second matrix mixing means.

3. An apparatus as claimed in claim 1 wherein said feedback response filtering comprises a reverberation filter.

4. An apparatus as claimed in claim 3 wherein said reverberation filter comprises one of a sparse tap FIR, a recursive algorithmic filter or a full convolution FIR filter.

5. An apparatus as claimed in claim 1 wherein said audio inputs comprise a surround sound set of signals.

6. An apparatus as claimed in claim 5 wherein said feedback inputs are mixed with the frontal portions of said audio inputs only.

7. An apparatus as claimed in claim 1 wherein said filter system includes a front sum filter filtering a summation of said audio inputs positioned in front of said idealized listener and said front sum filter comprises substantially an approximation of the sum of a direct and shadowed head related transfer function for said front inputs.

8. An apparatus as claimed in claim 1 wherein said filter system includes a front difference filter filtering a difference of said audio inputs positioned in front of said idealized listener and said front difference filter comprises substantially an approximation of the difference of a direct and shadowed head related transfer function for said front inputs.

9. An apparatus as claimed in claim 1 wherein said filter system includes a rear sum filter filtering a summation of said audio inputs positioned in rear of said idealized listener and said rear sum filter comprises substantially an approximation of the sum of a direct and shadowed head related transfer function for said rear inputs.

10. An apparatus as claimed in claim 1 wherein said filter system includes a rear difference filter filtering a difference of said audio inputs positioned in rear of said idealized listener and said rear difference filter comprises substantially an approximation of the difference of a direct and shadowed head related transfer function for said rear inputs.

11. An apparatus as claimed in claim 1 wherein said filter system includes a reverberation filter interconnected to the sum of said audio inputs.

12. An apparatus as claimed in claim 1, wherein said one or more filters to account for the direct response also account for the short time echo response of the room.

13. A method of operating a signal processing apparatus for creating, utilizing a pair of oppositely opposed headphones, the sensation of a sound source being spatially distant from the area between said pair of headphones, said method comprising:

(a) forming a first predetermined combination of a set of audio inputs and of one or more feedback inputs, the set of audio inputs representing audio signals each being projected from an idealized sound source located at a respective spatial location relative to an idealized listener, the set of audio inputs including at least a left audio input and a right audio input;

(b) forming a sum of said audio inputs;

(c) filtering said first predetermined combination to output filtered intermediate output signals to account for the direct response of a room, and;

(d) filtering said sum to output said one or more feedback inputs to account for a non-directional approximation to the reverberant response of the room, wherein said feedback inputs are non-directional such that the filtered intermediate output signals include filtered direct response signals and filtered reverberant signals that also account for the direct response, wherein said feedback inputs are non-directional; and (e) mixing said filtered intermediate output signals to produce left and right channel stereo outputs.

14. A method as recited in claim 13, wherein the filtering of (d) to account for the non-directional approximation uses at least a sparse tap FIR filter, or a recursive algorithmic filter, or a full convolution FIR filter.

15. A method as recited in claim 13, wherein the feedback inputs are mixed with the frontal portions of the audio inputs only.

16. A method of operating a signal processing apparatus for creating, utilizing a pair of oppositely opposed headphones, the sensation of a sound source being spatially distant from the area between said pair of headphones, said method comprising:

(a) accepting a set of audio inputs representing audio signals each being projected from an idealized sound source located at a respective spatial location relative to an idealized listener, the set of audio inputs including at least a left audio input and a right audio input;

(b) mixing said audio inputs and one or more feedback inputs to output a first predetermined combination of said audio inputs as intermediate output signals;

(b) combining said audio inputs to output a second predetermined combination of said audio inputs;

(c) filtering said second predetermined combination using a set of one or more feedback response filters to produce said one or more feedback inputs to account for a non-directional approximation to the reverberant response of the room;

(d) filtering said intermediate output signals and outputting filtered intermediate output signals, the filtering of the intermediate signals using one or more filter functions to account for the direct response of a room, such that the filtered intermediate output signals include filtered direct response signals and one or more filtered reverberant signals to account for the approximation to the reverberant response of the room.

(d) combining said filtered intermediate output signals to produce left and right channel stereo outputs.

17. A method as recited in claim 16, wherein the second predetermined combination includes a sum of said audio inputs.

18. A method as recited in claim 16, wherein the filtering of (c) to account for the non-directional approximation uses at least a sparse tap FIR filter, or a recursive algorithmic filter, or a full convolution FIR filter.

19. A method as recited in claim 16, wherein the audio inputs include a surround sound set of signals.

20. A method as recited in claim 16, wherein the feedback inputs are mixed with the frontal portions of the audio inputs only.

* * * * *